US007703900B2

(12) United States Patent
Morgan et al.

(10) Patent No.: US 7,703,900 B2
(45) **Date of Patent: *Apr. 27, 2010**

(54) INK PRESSURE REGULATOR USING AIR BUBBLES DRAWN INTO INK

(75) Inventors: John Douglas Peter Morgan, Balmain (AU); Miao Wang, Balmain (AU); Patrick John McAuliffe, Balmain (AU); David John Worboys, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 226 days.

This patent is subject to a terminal disclaimer.

(21) Appl. No.: 11/640,356

(22) Filed: Dec. 18, 2006

(65) Prior Publication Data

US 2008/0143801 A1 Jun. 19, 2008

(51) Int. Cl.
*B41J 29/38* (2006.01)
*B41J 2/175* (2006.01)

(52) U.S. Cl. ..... 347/85; 347/6; 347/86

(58) Field of Classification Search ..... 347/86, 347/87, 6, 85

See application file for complete search history.

(56) References Cited

U.S. PATENT DOCUMENTS

| | | | | |
|---|---|---|---|---|
| 6,000,790 | A * | 12/1999 | Takagi et al. | 347/87 |
| 6,168,267 | B1 * | 1/2001 | Komplin | 347/86 |
| 2002/0130933 | A1 * | 9/2002 | Chan et al. | 347/86 |
| 2003/0025773 | A1 | 2/2003 | Koizumi et al. | |
| 2004/0080590 | A1 | 4/2004 | Jung et al. | |
| 2005/0270347 | A1 * | 12/2005 | Yamamoto | 347/86 |

FOREIGN PATENT DOCUMENTS

JP 09-109397 A 4/1997

* cited by examiner

*Primary Examiner*—Matthew Luu
*Assistant Examiner*—Jannelle M Lebron

(57) ABSTRACT

There is provided an ink pressure regulator for regulating a hydrostatic pressure of ink supplied to an inkjet printhead. The regulator comprises: an ink chamber having an ink outlet for fluid communication with the printhead via an ink line; an air inlet open to atmosphere; a bubble outlet positioned for bubbling air into ink contained in the chamber; and an air channel connecting the air inlet and the bubble outlet. The bubble outlet is dimensioned to control a Laplace pressure of air bubbles drawn into the ink as result of supplying ink to the printhead. Hence, the hydrostatic pressure of the ink is regulated.

15 Claims, 12 Drawing Sheets

INK PRESSURE REGULATOR USING AIR BUBBLES DRAWN INTO INK

FIELD OF THE INVENTION

The present invention relates to a pressure regulator for an inkjet printer. It has been developed primarily for generating a negative hydrostatic pressure in an ink supply system supplying ink to printhead nozzles.

CO-PENDING APPLICATIONS

The following applications have been filed by the Applicant simultaneously with the present application:

Ser. Nos. 11/640,357 11/640358 11/640359 11/640360 11/640355

The disclosures of these co-pending applications are incorporated herein by reference.

CROSS REFERENCES TO RELATED APPLICATIONS

Various methods, systems and apparatus relating to the present invention are disclosed in the following US patents/patent applications filed by the applicant or assignee of the present invention:

| | | | | | |
|---|---|---|---|---|---|
| 6,988,841 | 6,641,315 | 6,786,661 | 6,808,325 | 6,712,453 | 6,460,971 |
| 6,428,147 | 6,416,170 | 6,402,300 | 6,464,340 | 6,612,687 | 6,412,912 |
| 6,447,099 | 7,249,108 | 6,566,858 | 6,331,946 | 6,246,970 | 6,442,525 |
| 7,346,586 | 09/505,951 | 6,374,354 | 7,246,098 | 6,816,968 | 6,757,832 |
| 6,334,190 | 6,745,331 | 7,249,109 | 7,197,642 | 7,093,139 | 10/636,263 |
| 10/636,283 | 10/866,608 | 7,210,038 | 7,401,223 | 10/940,653 | 10/942,858 |
| 7,090,337 | 11/478,585 | 6,913,346 | 10/853,336 | 7,156,494 | 7,032,998 |
| 6,994,424 | 7,001,012 | 7,004,568 | 7,040,738 | 7,188,933 | 7,131,715 |
| 7,261,392 | 7,182,435 | 7,097,285 | 7,083,264 | 7,147,304 | 7,156,498 |
| 7,201,471 | 11/503,084 | 7,364,256 | 7,258,417 | 7,293,853 | 7,328,968 |
| 7,270,395 | 11/003,404 | 11/003,419 | 7,334,864 | 7,255,419 | 7,284,819 |
| 7,229,148 | 7,258,416 | 7,273,263 | 7,270,393 | 6,984,017 | 7,347,526 |
| 7,357,477 | 11/003,463 | 7,364,255 | 7,357,476 | 11/003,614 | 7,284,820 |
| 7,341,328 | 7,246,875 | 7,322,669 | 7,445,311 | 7,452,052 | 7,455,383 |
| 7,448,724 | 7,441,864 | 11/482,975 | 11/482,970 | 11/482,968 | 11/482,972 |
| 11/482,971 | 11/482,969 | 11/518,238 | 11/518,280 | 11/518,244 | 11/518,243 |
| 11/518,242 | 11/246,676 | 11/246,677 | 7,448,722 | 11/246,679 | 7,438,381 |
| 7,441,863 | 7,438,382 | 7,425,051 | 7,399,057 | 11/246,671 | 11/246,670 |
| 11/246,669 | 7,448,720 | 7,448,723 | 7,445,310 | 7,399,054 | 7,425,049 |
| 7,367,648 | 7,370,936 | 7,401,886 | 11/246,708 | 7,401,887 | 7,384,119 |
| 7,401,888 | 7,387,358 | 7,413,281 | 11/482,958 | 11/482,955 | 11/482,962 |
| 11/482,963 | 11/482,956 | 11/482,954 | 11/482,974 | 11/482,957 | 11/482,987 |
| 11/482,959 | 11/482,960 | 11/482,961 | 11/482,964 | 11/482,965 | 11/482,976 |
| 11/482,973 | 11/495,815 | 11/495,816 | 11/495,817 | 6,227,652 | 6,213,588 |
| 6,213,589 | 6,231,163 | 6,247,795 | 6,394,581 | 6,244,691 | 6,257,704 |
| 6,416,168 | 6,220,694 | 6,257,705 | 6,247,794 | 6,234,610 | 6,247,793 |
| 6,264,306 | 6,241,342 | 6,247,792 | 6,264,307 | 6,254,220 | 6,234,611 |
| 6,302,528 | 6,283,582 | 6,239,821 | 6,338,547 | 6,247,796 | 6,557,977 |
| 6,390,603 | 6,362,843 | 6,293,653 | 6,312,107 | 6,227,653 | 6,234,609 |
| 6,238,040 | 6,188,415 | 6,227,654 | 6,209,989 | 6,247,791 | 6,336,710 |
| 6,217,153 | 6,416,167 | 6,243,113 | 6,283,581 | 6,247,790 | 6,260,953 |
| 6,267,469 | 6,588,882 | 6,742,873 | 6,918,655 | 6,547,371 | 6,938,989 |
| 6,598,964 | 6,923,526 | 6,273,544 | 6,309,048 | 6,420,196 | 6,443,558 |
| 6,439,689 | 6,378,989 | 6,848,181 | 6,634,735 | 6,299,289 | 6,299,290 |
| 6,425,654 | 6,902,255 | 6,623,101 | 6,406,129 | 6,505,916 | 6,457,809 |
| 6,550,895 | 6,457,812 | 7,152,962 | 6,428,133 | 7,216,956 | 7,080,895 |
| 7,442,317 | 7,182,437 | 7,357,485 | 7,387,368 | 11/607,976 | 11/607,975 |
| 11/607,999 | 11/607,980 | 11/607,979 | 11/607,978 | 7,204,941 | 7,282,164 |
| 10/815,628 | 7,278,727 | 7,417,141 | 7,452,989 | 7,367,665 | 7,138,391 |
| 7,153,956 | 7,423,145 | 7,456,277 | 10/913,376 | 7,122,076 | 7,148,345 |
| 11/172,816 | 11/172,815 | 11/172,814 | 11/482,990 | 11/482986 | 11/482,985 |
| 11/454,899 | 11/583,942 | 11/592,990 | 7,416,280 | 7,252,366 | 10/683,064 |
| 7,360,865 | 7,275,811 | 10/922,890 | 7,334,874 | 7,393,083 | 10/922,888 |
| 7,410,250 | 7,360,871 | 10/922,886 | 10/922,877 | 7,147,792 | 7,175,774 |
| 7,404,625 | 7,350,903 | 11/482,980 | 11/563,684 | 11/482,967 | 11/482,966 |
| 11/482,988 | 11/482,989 | 7,438,371 | 11/293,838 | 7,441,862 | 11/293,841 |
| 7,458,659 | 11/293,796 | 11/293,797 | 7,455,376 | 11/124,158 | 11/124,196 |
| 11/124,199 | 11/124,162 | 11/124,202 | 11/124,197 | 11/124,154 | 11/124,198 |
| 7,284,921 | 11/124,151 | 7,407,257 | 11/124,192 | 11/124,175 | 7,392,950 |
| 11/124,149 | 7,360,880 | 11/124,173 | 11/124,155 | 7,236,271 | 11/124,174 |
| 11/124,194 | 11/124,164 | 11/124,200 | 11/124,195 | 11/124,166 | 11/124,150 |
| 11/124,172 | 11/124,165 | 11/124,186 | 11/124,185 | 11/124,184 | 11/124,182 |
| 11/124,201 | 11/124,171 | 11/124,181 | 11/124,161 | 11/124,156 | 11/124,191 |
| 11/124,159 | 7,370,932 | 7,404,616 | 11/124,187 | 11/124,189 | 11/124,190 |
| 11/124,180 | 11/124,193 | 7,447,908 | 11/124,178 | 11/124,177 | 7,456,994 |
| 7,431,449 | 11/124,167 | 11/124,179 | 11/124,169 | 11/187,976 | 11/188,011 |
| 11/188,014 | 11/482,979 | 11/228,540 | 11/228,500 | 11/228,501 | 11/228,530 |
| 11/228,490 | 11/228,531 | 11/228,504 | 11/228,533 | 11/228,502 | 11/228,507 |
| 11/228,482 | 11/228,505 | 11/228,497 | 11/228,487 | 11/228,529 | 11/228,484 |
| 11/228,489 | 11/228,518 | 11/228,536 | 11/228,496 | 11/228,488 | 11/228,506 |
| 11/228,516 | 11/228,526 | 11/228,539 | 11/228,538 | 11/228,524 | 11/228,523 |

-continued

| | | | | | |
|---|---|---|---|---|---|
| 11/228,519 | 11/228,528 | 11/228,527 | 7,403,797 | 11/228,520 | 11/228,498 |
| 11/228,511 | 11/228,522 | 11/228,515 | 11/228,537 | 11/228,534 | 11/228,491 |
| 11/228,499 | 11/228,509 | 11/228,492 | 11/228,493 | 11/228,510 | 11/228,508 |
| 11/228,512 | 11/228,514 | 11/228,494 | 7,438,215 | 11/228,486 | 11/228,481 |
| 11/228,477 | 7,357,311 | 7,380,709 | 7,428,986 | 7,403,796 | 7,407,092 |
| 11/228,513 | 11/228,503 | 11/228,480 | 11/228,535 | 11/228,478 | 11/228,479 |
| 6,238,115 | 6,386,535 | 6,398,344 | 6,612,240 | 6,752,549 | 6,805,049 |
| 6,971,313 | 6,899,480 | 6,860,664 | 6,925,935 | 6,966,636 | 7,024,995 |
| 7,284,852 | 6,926,455 | 7,056,038 | 6,869,172 | 7,021,843 | 6,988,845 |
| 6,964,533 | 6,981,809 | 7,284,822 | 7,258,067 | 7,322,757 | 7,222,941 |
| 7,284,925 | 7,278,795 | 7,249,904 | 7,152,972 | 11/592,996 | 6,938,992 |
| 6,994,425 | 6,863,379 | 7,134,741 | 7,066,577 | 7,125,103 | 7,213,907 |
| 11/545,566 | 6,746,105 | 6,764,166 | 6,652,074 | 7,175,260 | 6,682,174 |
| 6,648,453 | 6,682,176 | 6,998,062 | 6,767,077 | 11/246,687 | 11/246,718 |
| 7,322,681 | 11/246,686 | 11/246,703 | 11/246,691 | 11/246,711 | 11/246,690 |
| 11/246,712 | 11/246,717 | 7,401,890 | 7,401,910 | 11/246,701 | 11/246,702 |
| 7,431,432 | 11/246,697 | 7,445,317 | 11/246,699 | 11/246,675 | 11/246,674 |
| 11/246,667 | 7,156,508 | 7,159,972 | 7,083,271 | 7,165,834 | 7,080,894 |
| 7,201,469 | 7,090,336 | 7,156,489 | 7,413,283 | 7,438,385 | 7,083,257 |
| 7,258,422 | 7,255,423 | 7,219,980 | 10/760,253 | 7,416,274 | 7,367,649 |
| 7,118,192 | 10/760,194 | 7,322,672 | 7,077,505 | 7,198,354 | 7,077,504 |
| 10/760,189 | 7,198,355 | 7,401,894 | 7,322,676 | 7,152,959 | 7,213,906 |
| 7,178,901 | 7,222,938 | 7,108,353 | 7,104,629 | 7,455,392 | 7,370,939 |
| 7,429,095 | 7,404,621 | 7,261,401 | 11/474,279 | 7,438,388 | 7,328,972 |
| 7,322,673 | 7,306,324 | 7,306,325 | 11/603,824 | 7,399,071 | 11/601,672 |
| 7,303,930 | 11/246,672 | 7,401,405 | 11/246,683 | 11/246,682 | 7,246,886 |
| 7,128,400 | 7,108,355 | 6,991,322 | 7,287,836 | 7,118,197 | 10/728,784 |
| 7,364,269 | 7,077,493 | 6,962,402 | 10/728,803 | 7,147,308 | 10/728,779 |
| 7,118,198 | 7,168,790 | 7,172,270 | 7,229,155 | 6,830,318 | 7,195,342 |
| 7,175,261 | 10/773,183 | 7,108,356 | 7,118,202 | 10/773,186 | 7,134,744 |
| 10/773,185 | 7,134,743 | 7,182,439 | 7,210,768 | 10/773,187 | 7,134,745 |
| 7,156,484 | 7,118,201 | 7,111,926 | 7,431,433 | 7,018,021 | 7,401,901 |
| 11/060,805 | 11/188,017 | 7,128,402 | 7,387,369 | 11/329,157 | 11/490,041 |
| 11/501,767 | 7,284,839 | 7,246,885 | 7,229,156 | 11/505,846 | 11/505,857 |
| 7,293,858 | 11/524,908 | 11/524,938 | 7,258,427 | 11/524,912 | 7,278,716 |
| 11/592,995 | 11/097,308 | 7,448,729 | 7,246,876 | 7,431,431 | 7,419,249 |
| 7,377,623 | 7,328,978 | 7,334,876 | 7,147,306 | 7,261,394 | 11/482,953 |
| 11/482,977 | 09/575,197 | 7,079,712 | 6,825,945 | 7,330,974 | 6,813,039 |
| 6,987,506 | 7,038,797 | 6,980,318 | 6,816,274 | 7,102,772 | 7,350,236 |
| 6,681,045 | 6,728,000 | 7,173,722 | 7,088,459 | 09/575,181 | 7,068,382 |
| 7,062,651 | 6,789,194 | 6,789,191 | 6,644,642 | 6,502,614 | 6,622,999 |
| 6,669,385 | 6,549,935 | 6,987,573 | 6,727,996 | 6,591,884 | 6,439,706 |
| 6,760,119 | 7,295,332 | 6,290,349 | 6,428,155 | 6,785,016 | 6,870,966 |
| 6,822,639 | 6,737,591 | 7,055,739 | 7,233,320 | 6,830,196 | 6,832,717 |
| 6,957,768 | 7,456,820 | 7,170,499 | 7,106,888 | 7,123,239 | 10/727,181 |
| 10/727,162 | 7,377,608 | 7,399,043 | 7,121,639 | 7,165,824 | 7,152,942 |
| 10/727,157 | 7,181,572 | 7,096,137 | 7,302,592 | 7,278,034 | 7,188,282 |
| 10/727,159 | 10/727,180 | 10/727,179 | 10/727,192 | 10/727,274 | 10/727,164 |
| 10/727,161 | 10/727,198 | 10/727,158 | 10/754,536 | 10/754,938 | 10/727,160 |
| 10/934,720 | 7,171,323 | 7,278,697 | 7,360,131 | 11/488,853 | 7,328,115 |
| 7,369,270 | 6,795,215 | 7,070,098 | 7,154,638 | 6,805,419 | 6,859,289 |
| 6,977,751 | 6,398,332 | 6,394,573 | 6,622,923 | 6,747,760 | 6,921,144 |
| 10/884,881 | 7,092,112 | 7,192,106 | 7,457,001 | 7,173,739 | 6,986,560 |
| 7,008,033 | 11/148,237 | 7,222,780 | 7,270,391 | 11/478,599 | 7,388,689 |
| 11/482,981 | 7,195,328 | 7,182,422 | 7,374,266 | 7,427,117 | 7,448,707 |
| 7,281,330 | 10/854,503 | 7,328,956 | 10/854,509 | 7,188,928 | 7,093,989 |
| 7,377,609 | 10/854,495 | 10/854,498 | 10/854,511 | 7,390,071 | 10/854,525 |
| 10/854,526 | 10/854,516 | 7,252,353 | 10/854,515 | 7,267,417 | 10/854,505 |
| 10/854,493 | 7,275,805 | 7,314,261 | 10/854,490 | 7,281,777 | 7,290,852 |
| 10/854,528 | 10/854,523 | 10/854,527 | 10/854,524 | 10/854,520 | 10/854,514 |
| 10/854,519 | 10/854,513 | 10/854,499 | 10/854,501 | 7,266,661 | 7,243,193 |
| 10/854,518 | 10/854,517 | 10/934,628 | 7,163,345 | 7,322,666 | 11/601,757 |
| 11/544,764 | 11/544,765 | 11/544,772 | 11/544,773 | 11/544,774 | 11/544,775 |
| 7,425,048 | 11/544,766 | 11/544,767 | 7,384,128 | 11/544,770 | 11/544,769 |
| 11/544,777 | 7,425,047 | 7,413,288 | 11/293,804 | 7,452,055 | 11/293,803 |
| 11/293,833 | 11/293,834 | 7,448,735 | 11/293,836 | 7,448,739 | 7,438,399 |
| 11/293,794 | 11/293,839 | 11/293,826 | 11/293,829 | 11/293,830 | 11/293,827 |
| 11/293,828 | 7,270,494 | 11/293,823 | 11/293,824 | 11/293,831 | 11/293,815 |
| 11/293,819 | 11/293,818 | 11/293,817 | 11/293,816 | 11/482,978 | 7,448,734 |
| 7,425,050 | 7,364,263 | 7,201,468 | 7,360,868 | 10/760,249 | 7,234,802 |
| 7,303,255 | 7,287,846 | 7,156,511 | 10/760,264 | 7,258,432 | 7,097,291 |
| 10/760,222 | 10/760,248 | 7,083,273 | 7,367,647 | 7,374,355 | 7,441,880 |
| 10/760,205 | 10/760,206 | 10/760,267 | 10/760,270 | 7,198,352 | 7,364,264 |
| 7,303,251 | 7,201,470 | 7,121,655 | 7,293,861 | 7,232,208 | 7,328,985 |
| 7,344,232 | 7,083,272 | 7,311,387 | 11/583,874 | 11/014,764 | 11/014,763 |
| 7,331,663 | 7,360,861 | 7,328,973 | 7,427,121 | 7,407,262 | 7,303,252 |
| 7,249,822 | 11/014,762 | 7,311,382 | 7,360,860 | 7,364,257 | 7,390,075 |
| 7,350,896 | 7,429,096 | 7,384,135 | 7,331,660 | 7,416,287 | 11/014,737 |
| 7,322,684 | 7,322,685 | 7,311,381 | 7,270,405 | 7,303,268 | 11/014,735 |

-continued

| | | | | | |
|---|---|---|---|---|---|
| 7,399,072 | 7,393,076 | 11/014,750 | 11/014,749 | 7,249,833 | 11/014,769 |
| 11/014,729 | 7,331,661 | 11/014,733 | 7,300,140 | 7,357,492 | 7,357,493 |
| 11/014,766 | 7,380,902 | 7,284,816 | 7,284,845 | 7,255,430 | 7,390,080 |
| 7,328,984 | 7,350,913 | 7,322,671 | 7,380,910 | 7,431,424 | 11/014,716 |
| 11/014,732 | 7,347,534 | 7,441,865 | 11/097,185 | 7,367,650 | 11/293,820 |
| 7,441,882 | 11/293,822 | 11/293,812 | 7,357,496 | 11/293,814 | 7,431,440 |
| 7,431,443 | 11/293,811 | 11/293,807 | 11/293,806 | 11/293,805 | 11/293,810 |
| 11/482,982 | 11/482,983 | 11/482,984 | 11/495,818 | 11/495,819 | 10/760,214 |
| 7,431,446 | 6,988,789 | 7,198,346 | 11/013,881 | 7,083,261 | 7,070,258 |
| 7,398,597 | 7,178,903 | 7,325,918 | 7,083,262 | 7,192,119 | 11/083,021 |
| 7,036,912 | 7,147,302 | 7,380,906 | 7,178,899 | 7,258,425 | 11/525,857 |
| 11/585,947 | 6,485,123 | 6,425,657 | 6,488,358 | 7,021,746 | 6,712,986 |
| 6,981,757 | 6,505,912 | 6,439,694 | 6,364,461 | 6,378,990 | 6,425,658 |
| 6,488,361 | 6,814,429 | 6,471,336 | 6,457,813 | 6,540,331 | 6,454,396 |
| 6,464,325 | 6,435,664 | 6,412,914 | 6,550,896 | 6,439,695 | 6,447,100 |
| 7,381,340 | 6,488,359 | 6,623,108 | 6,698,867 | 6,488,362 | 6,425,651 |
| 6,435,667 | 6,527,374 | 6,582,059 | 6,513,908 | 6,540,332 | 6,679,584 |
| 6,857,724 | 6,652,052 | 6,672,706 | 7,077,508 | 7,207,654 | 6,935,724 |
| 6,927,786 | 6,988,787 | 6,899,415 | 6,672,708 | 6,644,767 | 6,874,866 |
| 6,830,316 | 6,994,420 | 7,086,720 | 7,240,992 | 7,267,424 | 7,066,578 |
| 7,101,023 | 7,399,063 | 7,159,965 | 7,255,424 | 7,137,686 | 7,216,957 |
| 11/583,895 | 6,916,082 | 6,786,570 | 7,407,261 | 6,848,780 | 6,966,633 |
| 7,179,395 | 6,969,153 | 6,979,075 | 7,132,056 | 6,832,828 | 6,860,590 |
| 6,905,620 | 6,786,574 | 6,824,252 | 6,890,059 | 7,246,881 | 7,125,102 |
| 7,028,474 | 7,066,575 | 6,986,202 | 7,044,584 | 7,032,992 | 7,140,720 |
| 7,207,656 | 7,416,275 | 7,008,041 | 7,011,390 | 7,048,868 | 7,014,785 |
| 7,131,717 | 7,331,101 | 7,182,436 | 7,104,631 | 11/202,217 | 7,172,265 |
| 7,284,837 | 7,364,270 | 7,152,949 | 7,334,877 | 7,326,357 | 11/478,588 |
| 11/525,861 | 7,413,671 | 11/545,504 | 7,284,326 | 7,284,834 | 6,932,459 |
| 7,032,997 | 6,998,278 | 7,004,563 | 6,938,994 | 7,188,935 | 7,380,339 |
| 7,134,740 | 7,077,588 | 6,918,707 | 6,923,583 | 6,953,295 | 6,921,221 |
| 7,168,167 | 7,337,532 | 7,322,680 | 7,192,120 | 7,168,789 | 7,207,657 |
| 7,152,944 | 7,147,303 | 7,101,020 | 7,182,431 | 7,252,367 | 7,374,695 |
| 6,945,630 | 6,830,395 | 6,641,255 | 7,284,833 | 6,666,543 | 6,669,332 |
| 6,663,225 | 7,073,881 | 7,155,823 | 7,219,427 | 7,347,952 | 6,808,253 |
| 6,827,428 | 6,959,982 | 6,959,981 | 6,886,917 | 6,863,378 | 7,052,114 |
| 7,001,007 | 7,008,046 | 6,880,918 | 7,066,574 | 7,156,495 | 6,976,751 |
| 7,175,775 | 7,080,893 | 7,270,492 | 7,055,934 | 7,367,729 | 7,419,250 |
| 7,083,263 | 7,226,147 | 7,195,339 | 11/503,061 | 7,350,901 | 7,067,067 |
| 6,776,476 | 6,880,914 | 7,086,709 | 6,783,217 | 7,147,791 | 6,929,352 |
| 6,824,251 | 6,834,939 | 6,840,600 | 6,786,573 | 7,144,519 | 6,799,835 |
| 6,938,991 | 7,226,145 | 7,140,719 | 6,988,788 | 7,022,250 | 6,929,350 |
| 7,004,566 | 7,055,933 | 7,144,098 | 7,189,334 | 7,431,429 | 7,147,305 |
| 7,325,904 | 7,152,960 | 7,441,867 | 11/442,134 | 7,401,895 | 7,270,399 |
| 6,866,369 | 6,886,918 | 7,204,582 | 6,921,150 | 6,913,347 | 7,284,836 |
| 7,093,928 | 7,290,856 | 7,086,721 | 7,159,968 | 7,147,307 | 7,111,925 |
| 7,229,154 | 7,341,672 | 7,278,711 | | | |

The disclosures of these applications and patents are incorporated herein by reference.

BACKGROUND OF THE INVENTION

The inkjet printheads described in the above cross referenced documents typically comprise an array of nozzles, each nozzle having an associated ink ejection actuator for ejecting ink from a nozzle opening defined in a roof of a nozzle chamber. Ink from an ink cartridge or other reservoir is fed to the chambers where the ejection actuators force droplets of ink through the nozzle opening for printing. Typically, an ink cartridge is a replaceable consumable in an inkjet printer.

Ink may be drawn into each nozzle chamber by suction generated after each drop ejection and by the capillary action of ink supply channels having hydrophilic surfaces (e.g. silicon dioxide surface). During periods of inactivity, ink is retained in the nozzle chambers by the surface tension of an ink meniscus pinned across a rim of each nozzle opening. If the ink pressure is not controlled, it may become positive with respect to external atmospheric pressure, possibly by thermal expansion of the ink, or a tipping of the printer that elevates the ink above the level of the nozzles. In this case the ink will flood onto the printhead surface. Moreover, during active printing, ink supplied through the ink supply channels has a momentum, which is sufficient to surge out of the nozzles and flood the printhead face once printing stops. Printhead face flooding is clearly undesirable in either of these scenarios.

To address this problem, many printhead ink supply systems are designed so that a hydrostatic pressure of ink at the nozzles is less than atmospheric pressure. This causes the meniscus across the nozzle openings to be concave or drawn inwards. The meniscus is pinned at nozzle openings, and the ink cannot freely flow out of the nozzles, both during inactive periods. Furthermore, face flooding as a result of ink surges are minimized.

The amount of negative pressure in the chambers is limited by two factors. It cannot be strong enough to de-prime the chambers (i.e. suck the ink out of the chambers and back towards the cartridge). However, if the negative pressure is too weak, the nozzles can leak ink onto the printhead face, especially if the printhead is jolted. Aside from these two catastrophic events requiring some form of remediation (e.g. printhead maintenance or re-priming), a sub-optimal hydrostatic ink pressure will typically cause an array of image defects during printing, with an appreciable loss of print quality. Accordingly, inkjet printers may have a relatively narrow window of hydrostatic ink pressures, which must be achieved by a pressure regulator in the ink supply system.

Typically, ink cartridges are designed to incorporate some means for regulating hydrostatic pressure of ink supplied therefrom. To establish a negative pressure, some cartridges use a flexible bag design. Part of the cartridge has a flexible bag or wall section that is biased towards increasing the ink storage volume. U.S. Ser. No. 11/014,764 and U.S. Ser. No. 11/014,769 (listed above in the cross referenced documents) are examples of this type of cartridge. These cartridges can provide a negative pressure, but tend to rely on excellent manufacturing tolerances of an internal leaf spring in the flexible bag. Further, the requirement of an internal biasing means in a flexible bag presents significant manufacturing difficulties.

Another means of generating a negative ink pressure via the ink cartridge is shown in FIG. 17. A piece of foam or porous material 2 is placed in the cartridge 1 over the outlet 3. The foam 2 has a section that is saturated with ink 4, and a section 5 that may be wet with ink, but not saturated. The top of the cartridge 1 is vented to atmosphere through the air maze 7. Capillary action (represented by arrow 6) draws the ink from the saturated section 4 into the unsaturated section 5. This continues until it is balanced by the weight of the increased hydrostatic pressure, or 'head' of ink drawn upwards by the capillary action 6. The hydrostatic pressure at the top of the saturated section 4 is less than atmospheric because of capillary action into the unsaturated section 5. From there, the hydrostatic pressure increases towards the outlet 3, and if connected to the printhead (not shown), it continues to increase down to the nozzle openings (assuming they are the lowest points in the printhead). By setting the proportion of saturated foam to unsaturated foam such that the hydrostatic pressure of the ink at the nozzle is less than atmospheric, the ink meniscus will form inwardly.

However, ink cartridges comprising foam inserts are generally unsuitable for high speed printing (e.g. print speeds of one page every 1-2 seconds) using the Applicant's pagewidth printheads, which print at up to 1600 dpi. In such high speed printers, there are a large number of nozzles having a higher firing rate than traditional scanning printers. Therefore the ink flow rate out of the cartridge is much greater than that of a scanning printhead. The hydraulic drag caused by the foam insert can starve the nozzles and retard the chamber refill rate. More porous foam would have less hydraulic drag but also much less capillary force. Further, accurate pressure control requires equally accurate control over the internal void dimensions, which is difficult to achieved by the stochastically formed void structures of most foam materials. Accordingly, porous foam inserts are not considered to be a viable means for controlling ink pressure at high ink flow rates.

As an alternative (or in addition) to ink cartridges having integral pressure regulators, the ink supply system may comprise a pressure regulator in the ink line between the printhead and an ink reservoir. The present Applicant's previously filed U.S. application Ser. Nos. 11/293,806 (filed on Dec. 5, 2005) and 11/293,842 (filed on Dec. 5, 20055), the contents of which are herein incorporated by reference, describe an in-line pressure regulator comprising a diaphragm and biasing mechanism. This mechanical arrangement is used to generate a negative hydrostatic ink pressure at the printhead. However, this type of mechanical pressure regulator has the drawback of requiring extremely fine manufacturing tolerances for a spring, which opens and closes the diaphragm in response to fluctuations in ink pressure upstream and downstream of the diaphragm. In practice, this mechanical system of pressure control makes it difficult to implement in an ink supply system required to maintain a constant negative hydrostatic ink pressure within a relatively narrow pressure range.

It would therefore be desirable to provide a pressure regulator, which is suitable for maintaining a hydrostatic ink pressure within a relatively narrow pressure range. It would further be desirable to provide a pressure regulator, which is suitable for use at relatively high ink flow rates. It would further be desirable to provide a pressure regulator, which is simple in construction and which does not require a plethora of moving parts manufactured with high tolerances.

SUMMARY OF THE INVENTION

In a first aspect the present invention provides an ink pressure regulator for regulating a hydrostatic pressure of ink supplied to an inkjet printhead, said regulator comprising:

an ink chamber having an ink outlet for fluid communication with the printhead via an ink line;

an air inlet open to atmosphere;

a bubble outlet positioned for bubbling air into ink contained in the chamber; and an air channel connecting the air inlet and the bubble outlet, wherein said bubble outlet is dimensioned to control a Laplace pressure of air bubbles drawn into said ink as result of supplying ink to the printhead, thereby regulating a hydrostatic pressure of the ink.

Optionally, said ink chamber is an ink reservoir for a printer.

Optionally, said ink chamber has an ink inlet port for fluid communication with an ink reservoir.

Optionally, said bubble outlet is dimensioned such that a hydrostatic pressure of ink in the chamber is at least 10 mm $H_2O$ less than atmospheric pressure.

Optionally, said bubble outlet is dimensioned such that a hydrostatic pressure of ink in the chamber is at least 100 mm $H_2O$ less than atmospheric pressure.

Optionally, said bubble outlet has a critical dimension controlling the Laplace pressure of the air bubbles exiting the bubble outlet.

Optionally, said bubble outlet is configured as a circular opening, such that a radius of said circular opening controls the Laplace pressure of the air bubbles.

Optionally, said bubble outlet is configured as a slot having a length dimension and a width dimension, such that said width dimension controls the Laplace pressure of the air bubbles.

Optionally, a width of said slot is less than 200 microns.

Optionally, each cross-sectional dimension of said air channel is greater than the width of the slot, thereby minimizing flow resistance in the air channel.

Optionally, said air channel is bent or tortuous for minimizing ink losses through the air inlet.

Optionally, said air channel is dimensioned such that a maximum capillary volume of ink in said channel is less than about 0.1 mL.

Optionally, one wall of said chamber comprises an air intake plate, said plate comprising the air inlet, the air channel and the bubble outlet.

Optionally, said plate comprises a plurality of laminated layers, said layers cooperating to define the air inlet, the air channel and the bubble outlet.

Optionally, said plate comprises:

a first layer having an air inlet opening defined therethrough and an elongate recess defined in a first face thereof, said recess extending longitudinally from said air inlet aperture to a terminus; and a second layer laminated to said first face, said second layer having a bubble vent opening defined therethrough, wherein said bubble vent opening is positioned for fluid communication with said terminus.

Optionally, a depth of said recess towards said terminus defines a critical dimension of said bubble outlet, said critical dimension controlling a Laplace pressure of air bubbles exiting said bubble outlet.

Optionally, said recess has a shallower portion at said terminus, said shallower portion providing a constriction in said air channel.

Optionally, said terminus is defined by a circular recess having a diameter greater than said bubble vent opening, thereby providing a bubble outlet defined by an annular slot.

Optionally, said first face has a moat defined therein, said moat protecting said recess from adhesive during lamination of the first and second layers.

In a further aspect there is provided a pressure regulator, further comprising a pressure release valve for releasing excess pressure in a headspace above ink in said chamber.

In a second aspect the present invention provides a printhead ink supply system comprising:

an inkjet printhead;

an ink reservoir;

an ink pressure regulator for regulating a hydrostatic pressure of ink supplied to said printhead, said regulator comprising:

an ink chamber having an ink outlet;

an air inlet open to atmosphere;

a bubble outlet for bubbling air bubbles into the chamber, each air bubble comprising an air cavity trapped inside a film or a body of ink, said bubble outlet being dimensioned to control a Laplace pressure of air bubbles drawn into said chamber as result of supplying ink to the printhead, thereby regulating a hydrostatic pressure of the ink; and an air channel connecting the air inlet and the bubble outlet; and a first ink line providing fluid communication between said ink outlet and an inlet channel of said printhead.

Optionally, said ink reservoir is defined by said ink chamber.

Optionally, said ink pressure regulator is a replaceable ink cartridge.

In a further aspect there is provided an ink supply system, further comprising an ink cartridge defining said ink reservoir, said ink cartridge having an ink supply port in fluid communication with an ink inlet port of said ink chamber.

In a further aspect there is provided an ink supply system, further comprising a second ink line providing fluid communication between an outlet channel of said printhead and a return inlet of said ink reservoir, such that said ink supply system is a loop.

Optionally, said return inlet comprises an ink filter for filtering returned ink.

Optionally, a first pump is positioned in said first ink line upstream of said printhead.

Optionally, said first pump is open and idle during printing, such that said pressure regulator determines the hydrostatic pressure of the ink in the printhead during printing.

Optionally, a second pump is positioned in said second ink line downstream of said printhead.

Optionally, said first and second pumps are independently configurable for priming, depriming, purging and printing operations.

Optionally, said bubble outlet is dimensioned such that a hydrostatic pressure of ink in the chamber is at least 10 mm $H_2O$ less than atmospheric pressure.

Optionally, said bubble outlet has a critical dimension controlling the Laplace pressure of the air bubbles exiting the bubble outlet.

Optionally, said bubble outlet is configured as a slot having a length dimension and a width dimension, such that said width dimension controls the Laplace pressure of the air bubbles.

Optionally, a width of said slot is less than 200 microns.

Optionally, the bubble outlet is positioned for bubbling air bubbles into ink contained in the chamber, each air bubble comprising an air cavity trapped inside a body of ink.

In a further aspect there is provided a pressure regulator, further comprising a pressure-release valve for releasing excess pressure in a headspace above ink in said chamber.

Optionally, said air channel is bent or tortuous for minimizing ink losses through the air inlet.

Optionally, the bubble outlet is positioned for bubbling air bubbles into a headspace above ink contained in the chamber, each air bubble comprising an air bubble trapped inside a film of ink.

In a further aspect there is provided a pressure regulator, further comprising a capillary channel in fluid communication with ink contained in the ink chamber, said capillary channel supplying ink from the chamber to the bubble outlet by capillary action.

In a third aspect the present invention provides an ink pressure regulator for regulating a hydrostatic pressure of ink supplied to an inkjet printhead, said regulator comprising:

an ink chamber having an ink outlet for fluid communication with the printhead via an ink line;

an air inlet open to atmosphere;

a bubble outlet positioned for bubbling air bubbles into a headspace of the chamber, each air bubble comprising an air cavity trapped inside a film of ink;

a capillary channel in fluid communication with ink contained in the ink chamber, said capillary channel supplying ink from the chamber to the bubble outlet by capillary action; and an air channel connecting the air inlet and the bubble outlet, wherein said bubble outlet is dimensioned to control a Laplace pressure of air bubbles drawn into said chamber as result of supplying ink to the printhead, thereby regulating a hydrostatic pressure of the ink.

Optionally, said ink chamber is an ink reservoir for a printer.

Optionally, said ink chamber has an ink inlet port for fluid communication with an ink reservoir.

Optionally, said bubble outlet is dimensioned such that a hydrostatic pressure of ink in the chamber is at least 10 mm $H_2O$ less than atmospheric pressure.

Optionally, said bubble outlet is dimensioned such that a hydrostatic pressure of ink in the chamber is at least 100 mm $H_2O$ less than atmospheric pressure.

Optionally, said bubble outlet has a critical dimension controlling the Laplace pressure of the air bubbles exiting the bubble outlet.

Optionally, said bubble outlet is configured as a circular opening, such that a radius of said circular opening controls the Laplace pressure of the air bubbles.

Optionally, said bubble outlet is configured as a slot having a length dimension and a width dimension, such that said width dimension controls the Laplace pressure of the air bubbles.

Optionally, a width of said slot is less than 200 microns.

In a further aspect there is provided a pressure regulator, further comprising a bubble vent adjacent said bubble outlet, said bubble vent opening into said headspace.

Optionally, said bubble outlet and said bubble vent cooperate such that each air bubble breaks through a meniscus of ink pinned across said bubble outlet and vents into said chamber via said bubble vent.

Optionally, one wall of said chamber comprises an air intake plate, said plate comprising the air inlet, the air channel, the bubble outlet and the bubble vent.

Optionally, said plate comprises a plurality of laminated layers, said layers cooperating to define the air inlet, the air channel, the bubble outlet and the bubble vent.

Optionally, said plate comprises:

a first layer having an air inlet opening defined therethrough and an elongate recess defined in a first face thereof, said recess extending longitudinally from a proximal end at said air inlet aperture to a distal end; and a second layer laminated to said first face, said second layer having a capillary inlet opening and a bubble vent opening defined therethrough, wherein said capillary inlet opening is positioned towards said distal end of said recess and said bubble vent opening is positioned towards said proximal end of said recess.

Optionally, a depth of said recess at said proximal end defines a critical dimension of said bubble outlet, said critical dimension controlling a Laplace pressure of air bubbles exiting said bubble outlet.

Optionally, said bubble vent opening is dimensioned to pin a meniscus of ink across the opening by surface tension.

Optionally, said bubble vent opening is adjacent said bubble outlet.

Optionally, said recess is dimensioned to provide sufficient capillary pressure to raise a column of ink from said distal end to said proximal end.

In a fourth aspect the present invention provides an ink pressure regulator for regulating a hydrostatic pressure of ink supplied to an inkjet printhead, said regulator comprising:

an ink chamber having an ink outlet for fluid communication with the printhead via an ink line;

an air inlet open to atmosphere;

a bubble outlet for bubbling air bubbles into the chamber, each air bubble comprising an air cavity trapped inside a film or a body of ink; and an air channel connecting the air inlet and the bubble outlet, wherein said bubble outlet is dimensioned to control a Laplace pressure of air bubbles drawn into said chamber as result of supplying ink to the printhead, thereby regulating a hydrostatic pressure of the ink.

Optionally, said ink chamber is an ink reservoir for a printer.

Optionally, said ink chamber has an ink inlet port for fluid communication with an ink reservoir.

Optionally, said bubble outlet is dimensioned such that a hydrostatic pressure of ink in the chamber is at least 10 mm $H_2O$ less than atmospheric pressure.

Optionally, said bubble outlet is dimensioned such that a hydrostatic pressure of ink in the chamber is at least 100 mm $H_2O$ less than atmospheric pressure.

Optionally, said bubble outlet has a critical dimension controlling the Laplace pressure of the air bubbles exiting the bubble outlet.

Optionally, said bubble outlet is configured as a circular opening, such that a radius of said circular opening controls the Laplace pressure of the air bubbles.

Optionally, said bubble outlet is configured as a slot having a length dimension and a width dimension, such that said width dimension controls the Laplace pressure of the air bubbles.

Optionally, a width of said slot is less than 200 microns.

Optionally, the bubble outlet is positioned for bubbling air bubbles into ink contained in the chamber, each air bubble comprising an air cavity trapped inside a body of ink.

In a further aspect there is provided a pressure regulator, further comprising a pressure release valve for releasing excess pressure in a headspace above ink in said chamber.

Optionally, said air channel is bent or tortuous for minimizing ink losses through the air inlet.

Optionally, the bubble outlet is positioned for bubbling air bubbles into a headspace above ink contained in the chamber, each air bubble comprising an air bubble trapped inside a film of ink.

In a further aspect there is provided a pressure regulator, further comprising a capillary channel in fluid communication with ink contained in the ink chamber, said capillary channel supplying ink from the chamber to the bubble outlet by capillary action.

In a further aspect there is provided a pressure regulator, further comprising a bubble vent adjacent said bubble outlet, said bubble vent opening into said headspace.

In a fifth aspect the present invention provides an ink cartridge suitable for regulating a hydrostatic pressure of ink supplied to an inkjet printhead, said cartridge comprising:

an ink chamber having an ink outlet for fluid communication with the printhead via an ink line;

an air inlet open to atmosphere;

a bubble outlet for bubbling air bubbles into the chamber, each air bubble comprising an air cavity trapped inside a film or a body of ink; and an air channel connecting the air inlet and the bubble outlet, wherein said bubble outlet is dimensioned to control a Laplace pressure of air bubbles drawn into said chamber as result of supplying ink to the printhead, thereby regulating a hydrostatic pressure of the ink.

Optionally, said bubble outlet is dimensioned such that a hydrostatic pressure of ink in the chamber is at least 10 mm $H_2O$ less than atmospheric pressure.

Optionally, said bubble outlet is dimensioned such that a hydrostatic pressure of ink in the chamber is at least 100 mm $H_2O$ less than atmospheric pressure.

Optionally, said bubble outlet has a critical dimension controlling the Laplace pressure of the air bubbles exiting the bubble outlet.

Optionally, said bubble outlet is configured as a circular opening, such that a radius of said circular opening controls the Laplace pressure of the air bubbles.

Optionally, said bubble outlet is configured as a slot having a length dimension and a width dimension, such that said width dimension controls the Laplace pressure of the air bubbles.

Optionally, a width of said slot is less than 200 microns.

Optionally, the bubble outlet is positioned for bubbling air bubbles into ink contained in the chamber, each air bubble comprising an air cavity trapped inside a body of ink.

In a further aspect there is provided an ink cartridge, further comprising a pressure release valve for releasing excess pressure in a headspace above ink in said chamber.

Optionally, said air channel is bent or tortuous for minimizing ink losses through the air inlet.

Optionally, the bubble outlet is positioned for bubbling air bubbles into a headspace above ink contained in the chamber, each air bubble comprising an air bubble trapped inside a film of ink.

In a further aspect there is provided an ink cartridge, further comprising a capillary channel in fluid communication with ink contained in the ink chamber, said capillary channel supplying ink from the chamber to the bubble outlet by capillary action.

In a further aspect there is provided an ink cartridge, further comprising a bubble vent adjacent said bubble outlet, said bubble vent opening into said headspace.

In a further aspect there is provided an ink cartridge, which is a replaceable or disposable ink cartridge.

In a further aspect there is provided an ink cartridge, further comprising an ink inlet for receiving ink from the printhead.

In a further aspect there is provided an ink cartridge, further comprising an ink filter for filtering the received ink.

In a sixth aspect the present invention provides a method of regulating a hydrostatic pressure of ink supplied to an inkjet printhead, said method comprising:

withdrawing a volume of ink from an ink chamber and simultaneously bubbling air bubbles into the chamber via a bubble outlet to balance the withdrawn volume of ink, each air bubble being defined by an air cavity trapped by a film or a body of ink, wherein the bubble outlet is dimensioned to control a Laplace pressure of the air bubbles, thereby regulating a hydrostatic pressure of the ink.

Optionally, said ink chamber is an ink reservoir for a printer.

Optionally, said ink chamber has an ink inlet port for fluid communication with an ink reservoir.

Optionally, said bubble outlet is dimensioned such that a hydrostatic pressure of ink in the chamber is at least 10 mm $H_2O$ less than atmospheric pressure.

Optionally, said bubble outlet is dimensioned such that a hydrostatic pressure of ink in the chamber is at least 100 mm $H_2O$ less than atmospheric pressure.

Optionally, said bubble outlet has a critical dimension controlling the Laplace pressure of the air bubbles exiting the bubble outlet.

Optionally, said bubble outlet is configured as a circular opening, such that a radius of said circular opening controls the Laplace pressure of the air bubbles.

Optionally, said bubble outlet is configured as a slot having a length dimension and a width dimension, such that said width dimension controls the Laplace pressure of the air bubbles.

Optionally, a width of said slot is less than 200 microns.

Optionally, the bubble outlet is positioned for bubbling air bubbles into ink contained in the chamber, each air bubble comprising an air cavity trapped inside a body of ink.

Optionally, the bubble outlet is positioned for bubbling air bubbles into a headspace above ink contained in the chamber, each air bubble comprising an air bubble trapped inside a film of ink.

Optionally, a capillary channel supplies ink from the chamber to the bubble outlet by capillary action.

Optionally, a bubble vent adjacent said bubble outlet vents said air bubbles into said headspace.

Optionally, said volume of ink is withdrawn by a pumping effect of a printhead in fluid communication with an ink outlet of said chamber.

BRIEF DESCRIPTION OF THE DRAWINGS

Optional embodiments of the invention will now be described, by way of example only, with reference to the accompanying drawings, in which.

DETAILED DESCRIPTION OF OPTIONAL EMBODIMENTS

Pressure Regulator with Circular Bubble Outlet

Figure 1:
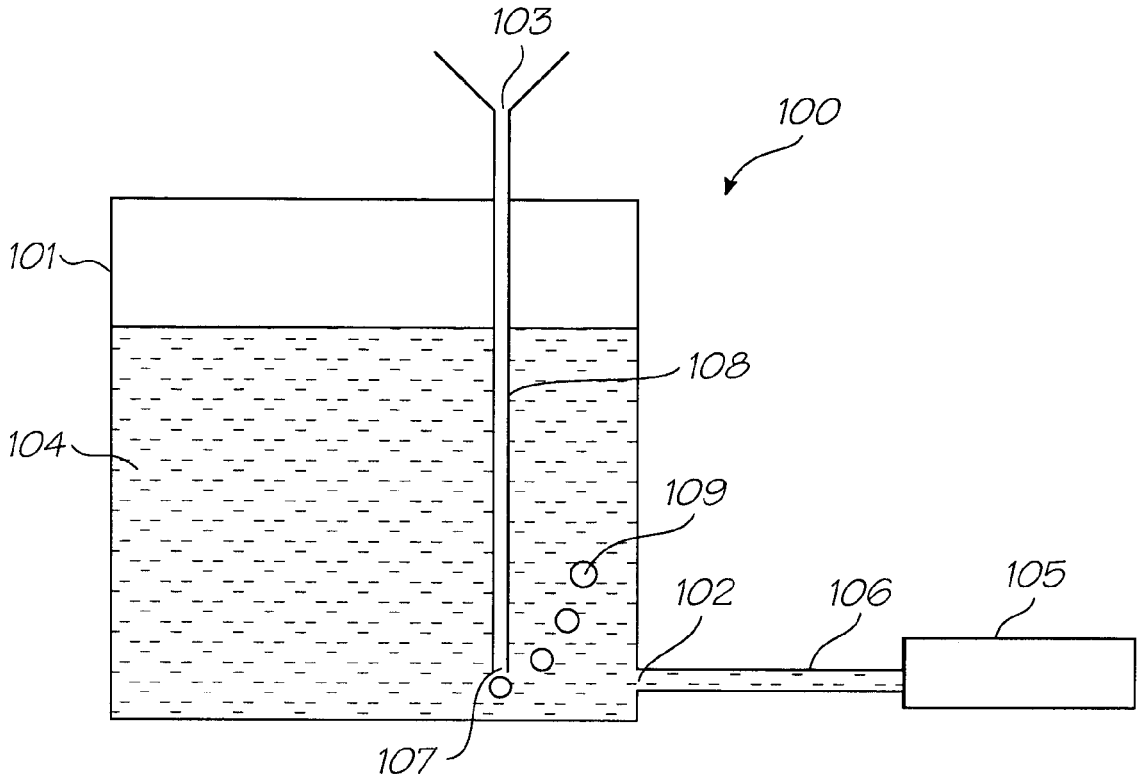
FIG. 1 is a schematic side section of a pressure regulator according to the present invention having a needle-like bubble outlet.

FIG. 1 shows the simplest form of the present invention, for the purposes of explaining the basic operating principle of the pressure regulator. In FIG. 1, there is shown a pressure regulator 100 comprising an ink chamber 101 having an ink outlet 102 and air inlet 103. The ink chamber 101 is otherwise sealed. The ink outlet 102 is for supplying ink 104 to a printhead 105 via an ink line 106. A bubble outlet 107 is connected to the air inlet 103 via an air channel 108.

When ink 104 is drawn from the ink chamber 101 by the printhead 105, the displaced volume of ink must be balanced with an equivalent volume of air, which is drawn into the chamber via the air inlet 103. The bubble outlet 107, which is positioned below the level of ink, ensures that the air enters the chamber 101 in the form of air bubbles 109. The dimensions of the bubble outlet 107 determine the size of the air bubbles 109 entering the chamber 101.

Figure 2:
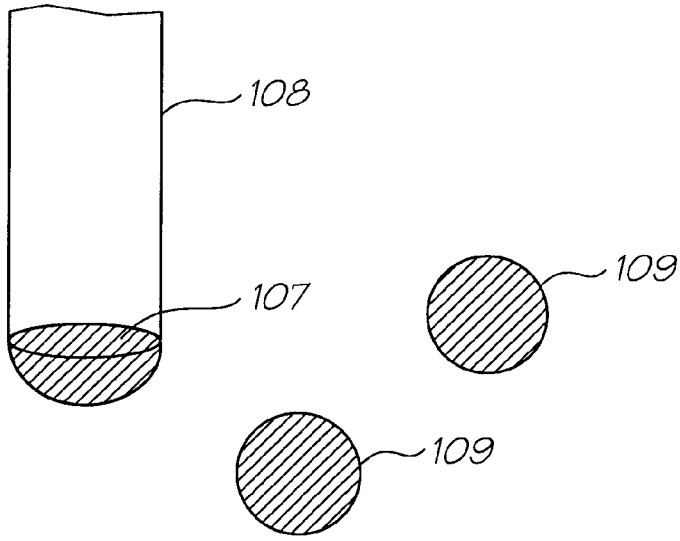
FIG. 2 is magnified view of the bubble outlet shown in FIG. 1.

As shown in FIG. 2, the air channel 108 takes the form of a simple cylindrical channel, so that the bubble outlet 107 is defined by a circular opening at one end of the cylindrical channel. Accordingly, any air passing through the channel must at some point be bounded by a liquid surface with radius of curvature not greater than the internal radius of the channel.

During printing, the nozzles on the printhead 105 effectively act as a pump, drawing ink from the ink chamber 101 with each drop ejection. If the ink chamber were left freely open to atmosphere with an air vent (as in some prior art ink cartridges), the hydrostatic ink pressure of the ink supplied to the printhead would be simply be the determined by the elevation of the ink reservoir above or below the printhead. However, in the ink chamber 101, each time a microscopic volume of ink is drawn from the chamber 101, it must overcome the pressure inside an air bubble 109 forming at the bubble outlet 107. Once the pumping effect of the nozzles generates sufficient pressure to match the pressure inside the air bubble 109 forming at the bubble outlet 107, then the air bubble can escape into the reservoir of ink 104 and ink can flow from the chamber 101 via the ink outlet 102.

Therefore, the air bubbles 109 forming at the bubble outlet 107 provide a back pressure against the pumping effect of the printhead nozzles. In other words, the effect of the bubble outlet 107 is to generate a negative hydrostatic ink pressure in the ink supply system.

The pressure inside the spherical air bubbles 109 is determined by the well-known Laplace equation:

$$\Delta P=2\gamma/r$$

where:

ΔP is the difference in pressure between the inside of the air bubble and the ink;

r is the radius of the air bubble; and

γ is the surface tension of the ink-air interface.

The size of the air bubbles 109 can be varied by varying the dimensions of the bubble outlet 107. Therefore, the dimensions of the bubble outlet 107 provides a means of establishing a predetermined negative hydrostatic pressure of ink supplied to the printhead 105. Smaller bubble outlet dimensions provide a larger negative hydrostatic ink pressure by virtue of generating smaller air bubbles having a higher Laplace pressure.

In the pressure regulator 100 described above, the air channel 108 is a small-bored cylinder (e.g. hypodermic needle) having a circular opening defining the bubble outlet 107. However, a significant problem with this design is that the circular bubble outlet 107 has a very small area (of the order of about 0.01 $mm^2$) and is susceptible to blockages by contaminants in the ink. It would be desirable to increase the area of the bubble outlet 107 so that it is more robust, even if there are contaminants in the ink.

Pressure Regulator with Slot-Shaped Bubble Outlet

Figure 3A:
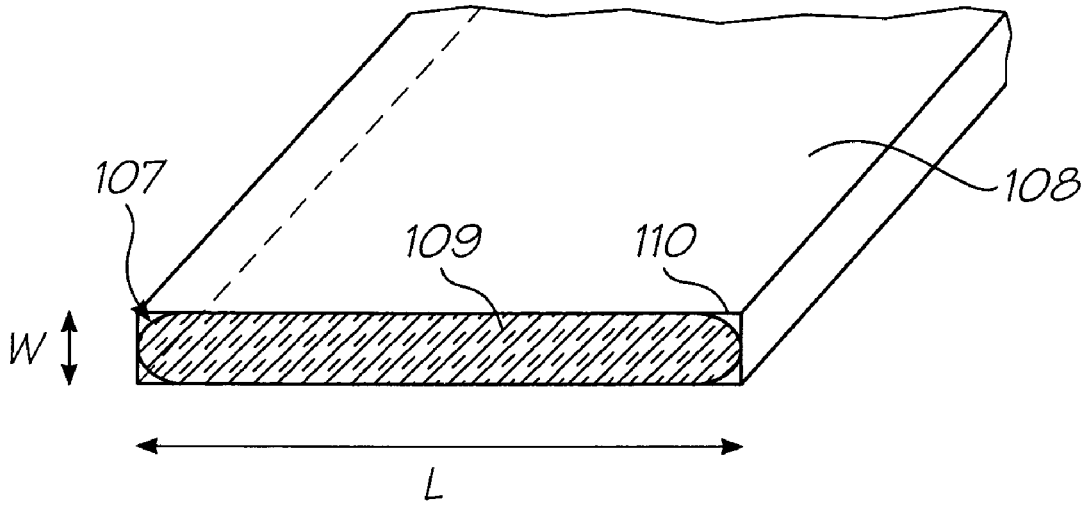
FIG. 3A is a schematic perspective view of a slot-shaped bubble outlet.

As shown in FIG. 3A, an improved design of bubble outlet 107 uses a slot 110, as opposed to a circular opening. The slot has a length dimension L and a width dimension W. The air bubbles 109 exiting the slot typically have a cylindrical front extending across the length of the slot. As explained below, the curvature of the air bubbles 109 exiting the slot and, hence, the Laplace pressure of the air bubbles, is determined primarily by the width dimension.

For non-spherical bubbles, the Laplace pressure is given by the expression:

$$\Delta P=\gamma/r_1+\gamma/r_2$$

where:

ΔP is the difference in pressure between the inside of the air bubble and the ink;

$r_1$ is the radius of a width dimension of the air bubble;

$r_2$ is the radius of a length dimension of the air bubble;

γ is the surface tension of the ink-air interface.

In practice, the length of the slot is much greater than the width ($r_2 >> r_1$), and so the Laplace pressure of the air bubbles exiting the slot with a cylindrical front becomes:

$$\Delta P=\gamma/r_1 \text{ or } 2\gamma/W \text{ (since } W=2r_1)$$

It will therefore be appreciated that the width of the slot 110 is the only critical dimension controlling the Laplace pressure of the air bubbles 109 exiting the slot.

Figure 3B:
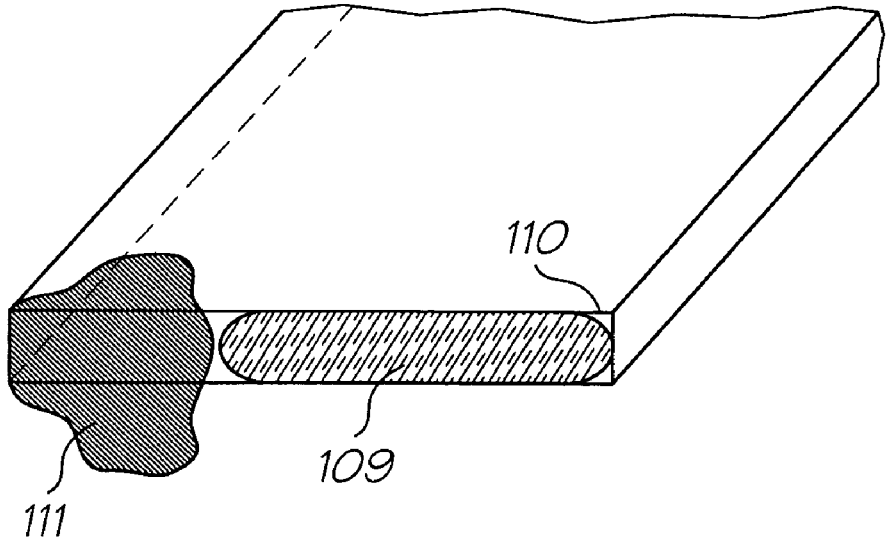
FIG. 3B shows the bubble outlet of FIG. 3A partially blocked with debris.

FIG. 3B shows a hypothetical scenario where a piece of debris 111 has become stuck to the slot 110. However, unlike the case of a circular opening, the slot 110 is still able to control the critical curvature of bubbles exiting the slot. An air bubble 109 having a cylindrical front can still exit the slot 110 as shown in FIG. 3B. Thus, the slot 110 provides a more robust design for the bubble outlet 107, whilst still maintaining excellent control of the hydrostatic ink pressure.

In the embodiments discussed so far, the dimensions of the air channel 108 mirror the dimensions of the bubble outlet 107. This is not an essential feature of the regulator and, in fact, may adversely affect the efficacy of the regulator, particularly at high flow rates. The inherent viscosity of air can cause a significant flow resistance or hydraulic drag in the air channel 108. According to Pouiseille's equation, flow rate has an $r^4$ relationship with pipe radius r. Hence, the problem of flow resistance is exacerbated in channels having very small radii.

In the present invention, a critical dimension of the bubble outlet 107 is optionally less than about 200 microns, or optionally less than about 150 microns, or optionally less than about 100 microns, or optionally less than about 75 microns or optionally less than about 50 microns. Optionally, the critical dimension of the bubble outlet may be in the range of 10 to 50 microns or 15 to 40 microns. By "critical dimension" it is meant the dimension of the bubble outlet determining the curvature and, hence, the Laplace pressure of the air bubbles.

Such dimensions are necessary to provide the desired negative hydrostatic ink pressure, which is optionally at least 10 $mmH_2O$, or optionally at least 30 $mmH_2O$, or optionally at least 50 $mmH_2O$ for a photo-sized printhead. For an A4-sized printhead, the desired negative hydrostatic ink pressure is optionally at least 100 $mmH_2O$, or optionally at least 200 $mmH_2O$, or optionally at least 300 $mmH_2O$. Optionally, the negative hydrostatic pressure may be in the range of 100 to 500 $mmH_2O$ or 150 to 450 $mmH_2O$ The air channel 108, having a width of, say, less than 200 microns, generates significant flow resistance for air entering the channel. If air is unable to pass through the channel 108 at the same flow rate as ink is supplied to the printhead 105, then a catastrophic deprime of the printhead would result at high print-speeds.

Accordingly, it is desirable to configure the air channel 108 so that each cross-sectional dimension of the air channel is larger than the critical dimension of the bubble outlet 107. So, for the slot-shaped bubble outlet 107 shown in FIG. 3A, the air channel 108 should optionally have each cross-sectional dimension greater than the width W of the slot 110.

However, it is important that the volume of the air channel 108 is not too large. When the printhead 105 is idle, ink may rise up the air channel 108 by capillary action. This volume of ink must be pulled through the air channel 108 by the printhead 105 before air bubbles 109 are drawn into the ink chamber 101 and the optimal hydrostatic ink pressure for printing is reached. Hence, a volume of ink drawn into the air channel 108 by capillary action during idle periods will be wasted, since it cannot be printed with optimal print quality.

The capillary volume of ink increases with the radius of the air channel. Accordingly, the cross-sectional dimensions (e.g. radius) of the air channel 108 should optionally not be so large that the maximum capillary volume exceeds about 0.1 mL of ink, which is effectively a dead volume of ink. Optionally, the maximum capillary volume of ink in the air channel is less than about 0.08 mL, or optionally less than about 0.05 mL, or optionally less than about 0.03 mL.

Figure 4:
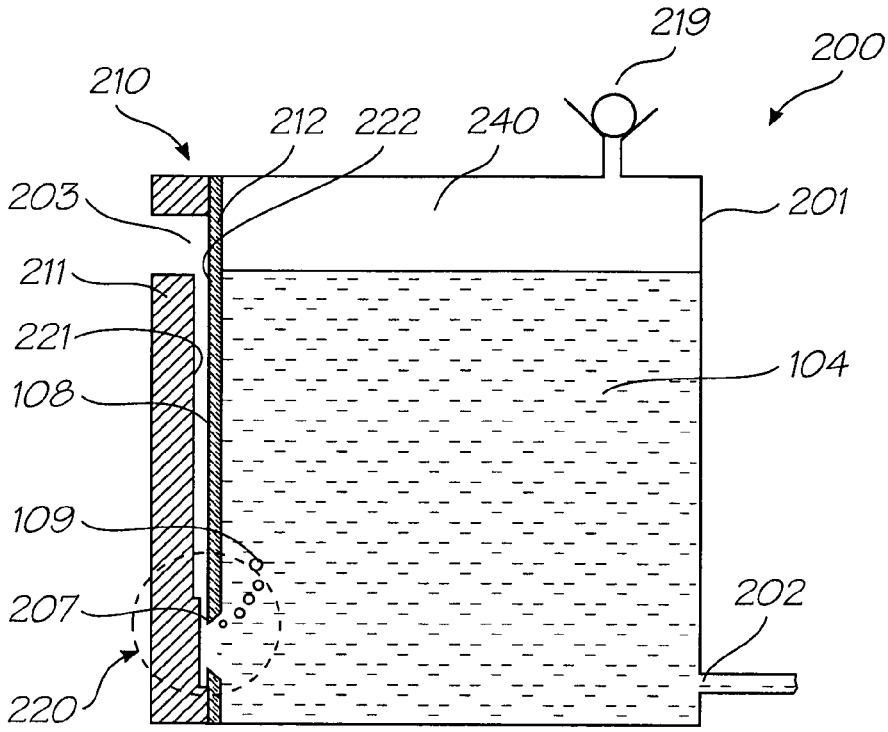
FIG. 4 is a schematic side section of a pressure regulator according the present invention having a slot-shaped bubble outlet.

FIG. 4 shows an alternative ink pressure regulator 200 having a bubble outlet 207 and air channel 208 with the abovementioned design considerations taken into account. The pressure regulator 200 comprises an ink chamber 201 having an ink outlet 102. One sidewall of the ink chamber 201 is defined by a laminated air intake plate 210 comprising first and second planar layers 211 and 212. The first and second layers 211 and 212 have respective first and second faces 221 and 222 which cooperate to define the air inlet 203, the air channel 208 and the bubble outlet 207. The air inlet 203 may optionally comprise an air filter (not shown) for filtering particulates from air drawn into the ink chamber 201.

The ink chamber 201 also comprises a one-way pressure release valve 219, which is normally closed during operation of the pressure regulator 200. The valve 219 is configured to release any positive pressure in a headspace 240 above the ink 104, which may, for example, result from thermal expansion of a volume of air trapped in the headspace during typical day/night temperature fluctuations. A positive pressure in the headspace 240 is undesirable because it forces ink up the air channel 208 and out of the air inlet 203, leading to appreciable ink losses from the chamber 201.

Figure 6:
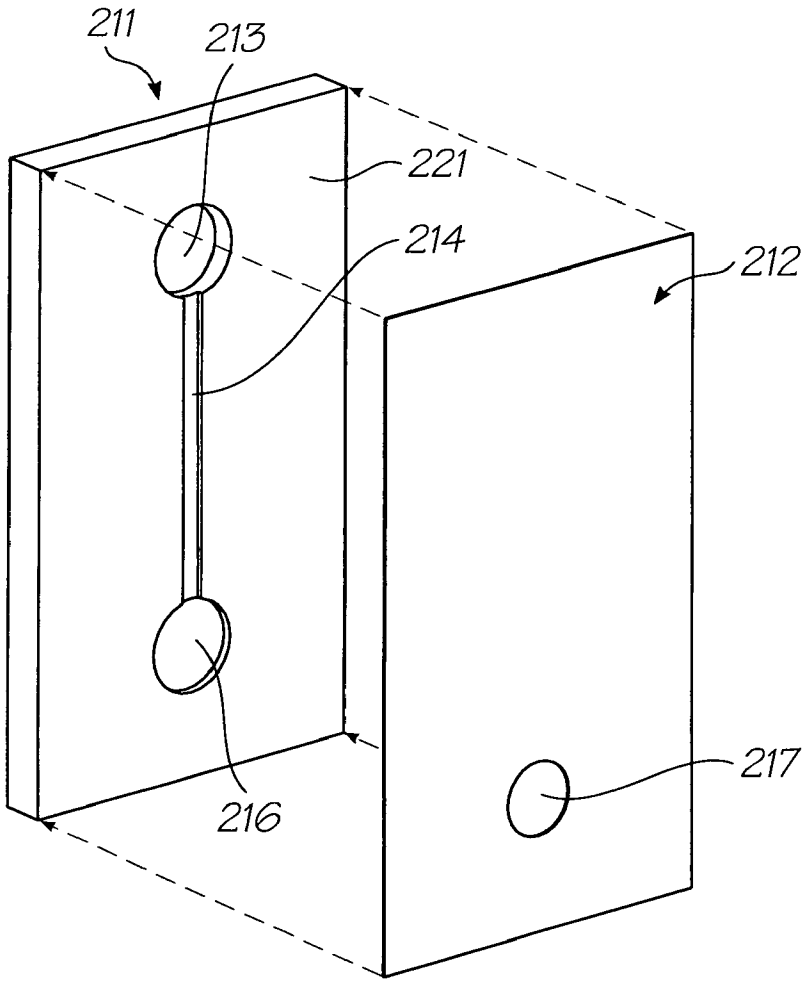
FIG. 6 is an exploded perspective view of the air intake plate shown in FIG. 4.

Referring to FIG. 6, the first layer 211 of the air intake plate 210 has an air inlet opening 213 defined therethrough and an elongate recess 214 in the form of a groove defined in the first face 221. The elongate recess 214 extends from the air inlet opening 213 to a recessed terminus region. The recessed terminus region comprises a circular recess 216 which has a relatively shallow depth compared to the elongate recess 214. Still referring to FIG. 6, the second layer 212 has a bubble vent opening 217 defined therethrough. As will be appreciated from FIGS. 4 and 6, when the first and second faces 221 and 222 are laminated together, the recesses and openings cooperate to define the air inlet 203, the air channel 208 and the bubble outlet 207.

Figure 5:
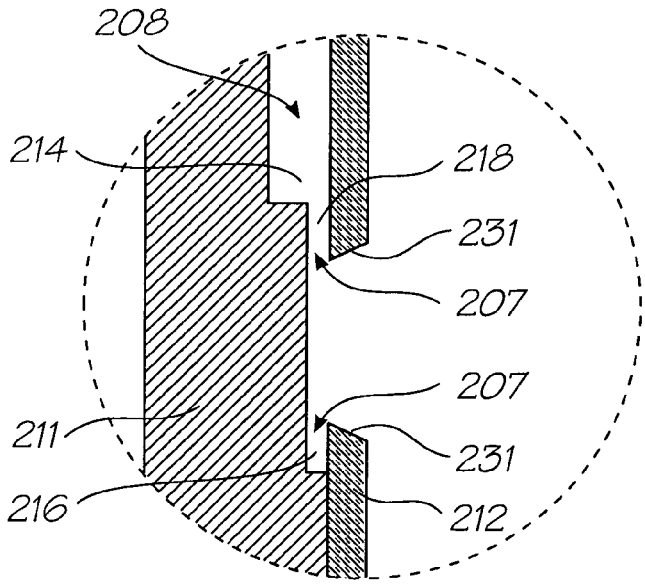
FIG. 5 is a magnified view of the bubble outlet shown in FIG. 4.

FIG. 5 shows in detail a bubble outlet region 220 of the air intake plate 210. The circular recess 216, being shallower than the elongate recess 214, defines a constriction 218 in the air channel 108. This constriction 218, defined by the depth of the circular recess 216 in the first face 221, defines a critical width dimension for the bubble outlet 207. The bubble outlet 207 therefore takes the form of an annular slot with a length of the slot being defined by a circumference of the bubble vent opening 217 in the second layer 212.

An advantage of having an annular slot is that it maximizes the length of the slot, thereby improving the robustness of the bubble outlet 207 to particulate contamination. An advantage of having a relatively deep elongate recess 214 is that it minimizes flow resistance in the air channel 108 defined by cooperation of the recess 214 and the second face 222. Typically, the elongate recess 214 has a depth in the range of 0.2 to 1 mm or 0.2 to 0.5 mm, and a width in the range of 0.5 to 2 mm or 0.7 to 1.3 mm.

Still referring to FIG. 5, it can be seen that inner faces 231 of the bubble vent opening 217 are beveled so as to optimize escape of bubbles from the bubble outlet 207.

Figure 7:
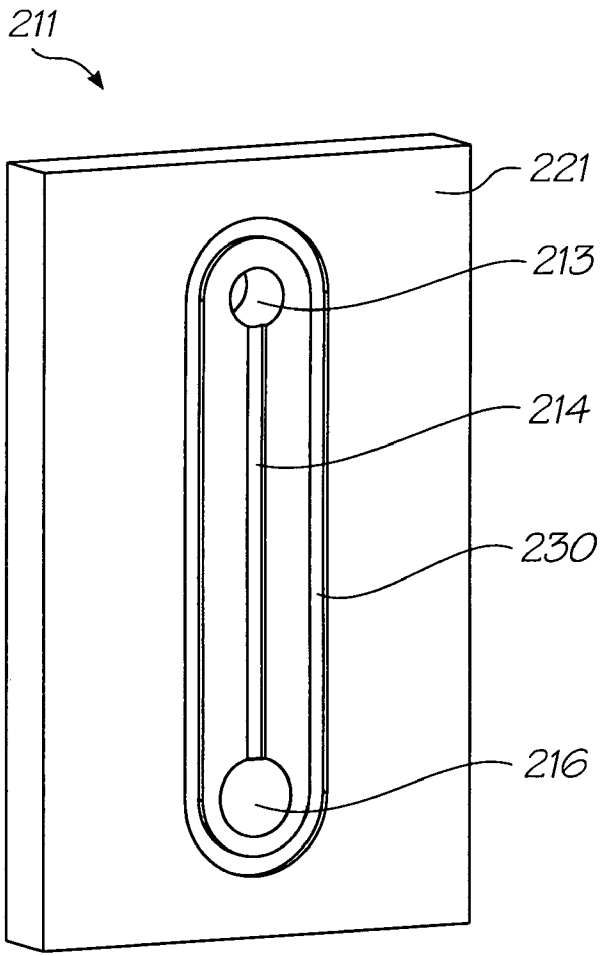
FIG. 7 is a perspective view of an alternative air intake plate with protective moat.

Referring to FIG. 7, the first layer 211 of the air intake plate 210 may have a moat 230 defined therein. The moat 230 surrounds the features defined in the first layer 211 and, importantly, protects the elongate recess 214 and circular recess 216 from any adhesive during the lamination process. The wicking of any excess adhesive between the first and second faces 221 and 222 is arrested by the moat 230 as capillary action can only transport liquids into of structures ever decreasing dimensions, and any path across the moat includes a region of increasing dimension. This prevents blocking of the air inlet channel 208 or the bubble outlet opening 207, which are defined by lamination of the two layers. Hence, the moat 230 is a feature, which facilitates manufacture of the air intake plate 210.

Figure 8:
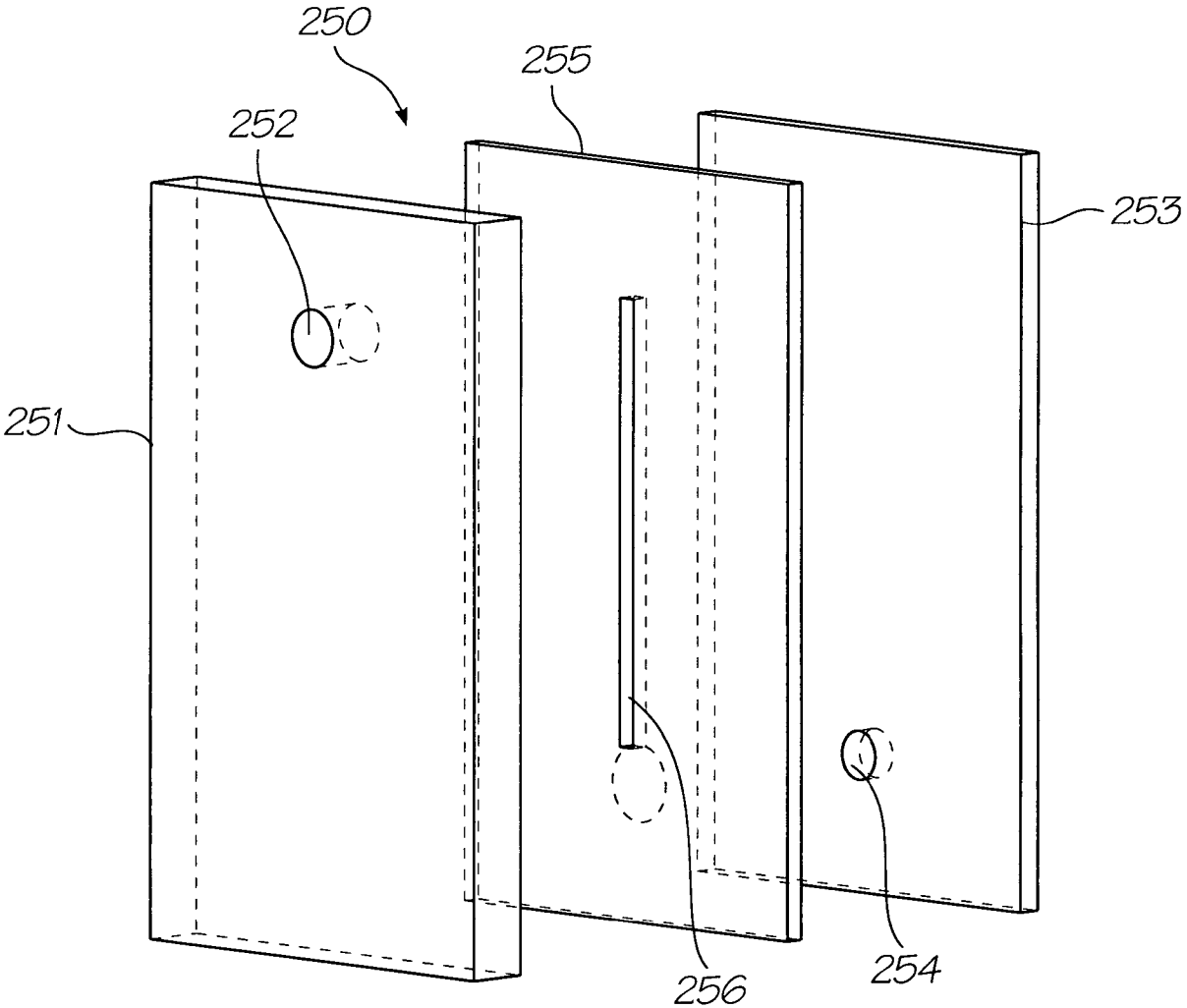
FIG. 8 is an exploded perspective view of an alternative tri-layered air intake plate.

Of course, it will be appreciated that the air intake plate may take many different forms and may, for example, be defined by cooperation of more than two laminated layers. FIG. 8 shows an air intake plate 250 defined by cooperation of three layers. A first layer 251 has an air inlet opening 252 defined therethrough; a second layer 253 has an bubble vent opening 254 defined therethrough; and a third film layer 255 is sandwiched between the first and second layers. The film layer 255 has an air channel opening 256 defined therethrough, so that when the three layers are laminated together a fluidic path is defined from an air inlet to the bubble vent. The thickness of the film layer 255 defines the depth of the air channel and the critical dimension of the bubble outlet at the terminus of the air channel.

Tables 1 to 4 below show measured hydrostatic ink pressures for the pressure regulator 200 shown in FIGS. 4 to 6. Four pressure regulators were constructed having different critical dimensions of the bubble outlet 207. Dynamic pressure measurements were made at various flow rates and static pressure measurements were made by stopping the flow of ink. The dynamic pressure loss is the difference between the dynamic regulating pressure and the static regulating pressure.

TABLE 1

| | 35 micron bubble outlet | | |
|---|---|---|---|
| Flow Rate (ml/sec) | Dynamic Regulating Pressure (mm $H_2O$) | Static Regulating Pressure (mm $H_2O$) | Dynamic Pressure Loss (mm $H_2O$) |
| 0.05 | −203 | −178 | −25 |
| 0.04 | −196 | −175 | −21 |
| 0.03 | −194 | −178 | −16 |
| 0.02 | −189 | −173 | −16 |
| 0.01 | −185 | −175 | −10 |
| 0.005 | −172 | −165 | −7 |
| | | −174 (Average) | |

TABLE 2

| 70 micron bubble outlet | | | |
|---|---|---|---|
| Flow Rate (ml/sec) | Dynamic Regulating Pressure (mm $H_2O$) | Static Regulating Pressure (mm $H_2O$) | Dynamic Pressure Loss (mm $H_2O$) |
| 0.05 | −110 | −84 | −26 |
| 0.04 | −104 | −79 | −25 |
| 0.03 | −100 | −84 | −16 |
| 0.02 | −91 | −79 | −12 |
| 0.01 | −84 | −83 | −1 |
| 0.005 | −80 | −76 | −4 |
| | | −81 (Average) | |

TABLE 3

| 105 micron bubble outlet | | | |
|---|---|---|---|
| Flow Rate (ml/sec) | Dynamic Regulating Pressure (mm $H_2O$) | Static Regulating Pressure (mm $H_2O$) | Dynamic Pressure Loss (mm $H_2O$) |
| 0.05 | −65 | −38 | −27 |
| 0.04 | −65 | −44 | −21 |
| 0.03 | −56 | −40 | −16 |
| 0.02 | −51 | −38 | −13 |
| 0.01 | −43 | −38 | −5 |
| 0.005 | −38 | −36 | −2 |
| | | −39 (Average) | |

TABLE 4

| 140 micron bubble outlet | | | |
|---|---|---|---|
| Flow Rate (ml/sec) | Dynamic Regulating Pressure (mm $H_2O$) | Static Regulating Pressure (mm $H_2O$) | Dynamic Pressure Loss (mm $H_2O$) |
| 0.05 | −60 | −32 | −28 |
| 0.04 | −56 | −34 | −22 |
| 0.03 | −54 | −36 | −18 |
| 0.02 | −51 | −37 | −14 |
| 0.01 | −38 | −34 | −4 |
| 0.005 | −34 | −31 | −3 |
| | | −34 (Average) | |

Excellent control of ink pressure was achievable simply by varying the dimensions of the bubble outlet.

Moreover, the pressure measurements confirmed that the air bubbles were being generated in accordance with the Laplace equation. The average static regulating pressures were found to obey the equation:

$$P=-0.0067/W+18.3$$

where:

P is the average static regulating pressure in millimeters of water head;

W is the width of the bubble outlet in micron; and 18.3 is an offset pressure due to the level of ink in the chamber.

Substituting the first term into the Laplace equation, the surface tension γ of the ink was calculated as 33.5 mN/m. Independent surface tension measurements of the ink correlated well with this calculated figure.

Ink Cartridge Comprising Pressure Regulator

As shown in FIG. 4, the pressure regulator 200 comprises an ink chamber 201, which defines an ink reservoir for the printhead. Due to the simplicity and low-cost manufacture of the pressure regulator 200, it may be constructed as a replaceable ink cartridge for an inkjet printer. Hence, each time the ink cartridge is replaced, the pressure regulator is replaced. An advantage of this design is that long-term fouling of the pressure regulator 200 is avoided, because it is periodically replaced during the lifetime of the printer.

Replaceable Ink Cartridge Connected to Pressure Regulator

In an alternative embodiment, the pressure regulator may be a permanent component of a printer. In this alternative embodiment, the pressure regulator is configured for connection to a replaceable ink cartridge. Hence, in the embodiment shown in FIG. 9, the pressure regulator 200 is connected to a replaceable ink cartridge 280 via a pair of connectors. An ink connector 281 connects an ink supply port 282 of the ink cartridge 280 with an ink inlet port 283 of the ink chamber 201. The ink supply port 282 and corresponding ink inlet port 283 are positioned towards a base of the ink cartridge 280 and ink chamber 201 respectively, to maximize usage of ink 104 stored in the cartridge.

A pressure-equalizing connector 285 is positioned to equalize pressure in the headspace 240 of the ink chamber 201 and a headspace 241 of the ink cartridge 280. Corresponding pressure-equalizing ports 286 and 287 are positioned towards a roof of the ink chamber 201 and ink cartridge 280, respectively.

When the ink cartridge 280 is empty, it is disconnected from the ink connector 281 and the pressure-equalizing connector 285, and removed from the printer. A new ink cartridge can then be installed in the printer by the reverse process. Although only shown schematically in FIG. 9, it will be readily appreciated that the ink cartridge 280 may have suitable connection ports 282 and 287, which are configured for sealing engagement with the ink connector 281 and pressure-equalizing connector 285, respectively, when the ink cartridge is installed in the printer. Connection ports suitable for such sealing engagement are well known in the art.

Figure 9:
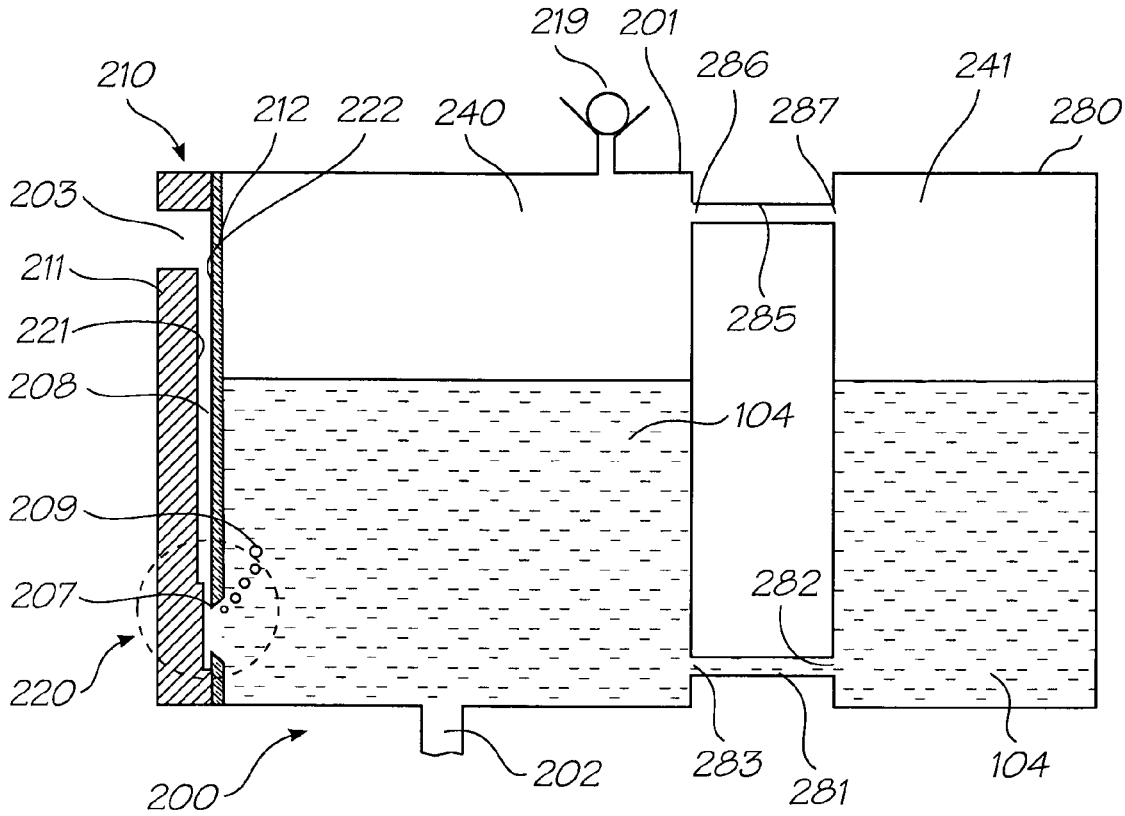
FIG. 9 is a schematic side section of the pressure regulator shown in FIG. 4 connected to a separate ink cartridge.

As shown in FIG. 9 the ink inlet port 283 and pressure-equalizing port 286 are defined in a sidewall of the ink chamber 201 which is opposite to the air intake plate 210. However, the ports 283 and 286, may of course be defined in the air intake plate 210 so as to simplify construction of the pressure regulator 200.

Bubble Outlet Positioned in Headspace

In the pressure regulator described in FIG. 4, the bubble outlet 207 is positioned so as to bubble air bubbles 209 into a body of ink 104 contained in the ink chamber 201. Typically, the bubble outlet 207 is positioned towards a base of the chamber 201 in order to maximize ink usage at optimal hydrostatic pressure, with the air inlet 203 being positioned towards a roof of the chamber. A problem with this arrangement is that ink 104 contained in the chamber 201 can easily escape up the air channel 208 and out of the air inlet 203 during idle periods as a consequence of temperature fluctuations, whereby heating air in the headspace 240 increase the headspace pressure and forces ink up the air channel 208 and out of the air inlet 203. Such temperature fluctuations are unavoidable and can result in significant ink wastage.

As already alluded to above, one means of addressing this problem is by incorporating a pressure-release valve 219 into the ink chamber 201. This valve 219 is configured to release any positive pressure in the headspace 240. However, valves of this type add significantly to the cost and complexity of the pressure regulator. Hence, the pressure-release valve 219 makes the pressure regulator 200 less amenable for incorporation into a disposable ink cartridge.

It would therefore be desirable to provide an ink pressure regulator, which does waste quantities of ink during temperature fluctuations and does not require a pressure-release valve, and which is therefore more amenable for incorporation into a disposable ink cartridge.

Figure 10:
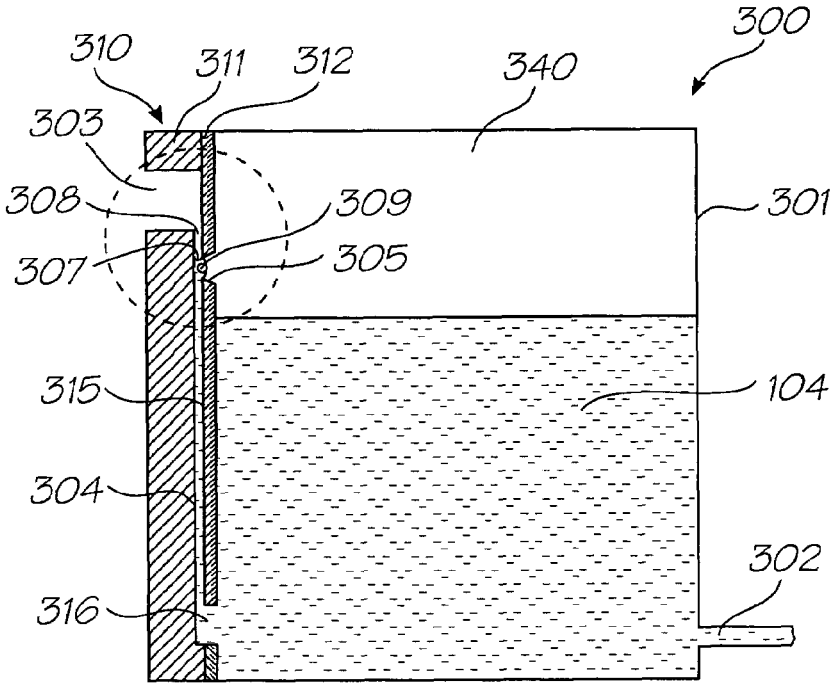
FIG. 10 is a schematic side section of a pressure regulator with bubble outlet positioned for bubbling air bubbles into a headspace.

FIG. 10 shows an ink pressure regulator 300, which meets the above-mentioned criteria. The ink pressure regulator is similar in design to that shown in FIG. 4 and still relies on controlling the Laplace pressure of air bubbles entering the ink chamber. However, rather than air bubbles bubbling into a body of ink contained in the chamber, the air bubbles enter the chamber via the headspace above the body of the ink. This design enables any excess pressure in the headspace to vent through the air inlet during idle periods, as will be explained in more detail below.

Referring to FIG. 10, the ink pressure regulator 300 comprises an ink chamber 301 having an ink outlet 302. One sidewall of the ink chamber 301 is defined by a laminated air intake plate 310 comprising first and second planar layers 311 and 312, which cooperate to define an air inlet 303, a bubble outlet 307, a bubble vent 305, an air channel 308, a capillary channel 315 and a capillary inlet 316. The bubble outlet 307 and bubble vent 305 are positioned above the level of ink in the chamber 301 so that air bubbles 309 enter the headspace 340 of the chamber via the bubble vent. The bubble outlet 307 is connected to the air inlet 303 via the air channel 308. The bubble outlet 307 is generally slot-shaped and is critically dimensioned to control the Laplace pressure of air bubbles 309 as ink is drawn from the ink outlet 302.

Figure 11:
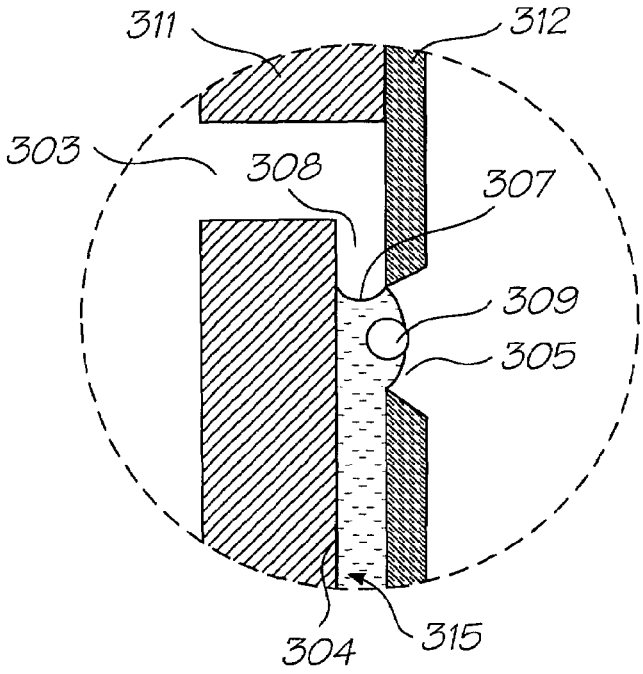
FIG. 11 is a magnified view of the bubble outlet shown in FIG. 10 during bubble formation.

However, in contrast to previous embodiments, the air bubbles 309 are formed by air breaking through a meniscus of ink pinned across the bubble outlet 307 and adjacent bubble vent 305, as shown more clearly in FIG. 11. The so-formed air bubbles 309 emerging from the bubble outlet 307 escape through the bubble vent 305 and into the headspace 340 of the ink chamber 301. Since the air must break through an ink meniscus, the air bubbles 309: are defined by an air cavity trapped inside a film of ink, rather than a whole body of ink. Regardless, the same Laplacian pressure control is still achievable, as described above.

The capillary inlet 316 provides fluid communication between the body of ink 104 in the chamber 301 and the capillary channel 315 defined between the two layers 311 and 312. The capillary channel 315 is configured to provide sufficient capillary pressure such that a column of ink 304 rises up the channel at least as high as the bubble outlet 307, thereby ensuring formation of air bubbles 309 by air breaking through a meniscus of ink. The capillary pressure is sufficiently high to re-form a meniscus across the bubble outlet 307 and bubble vent 305 after each air bubble 309 has vented into the headspace 340.

Figure 12:
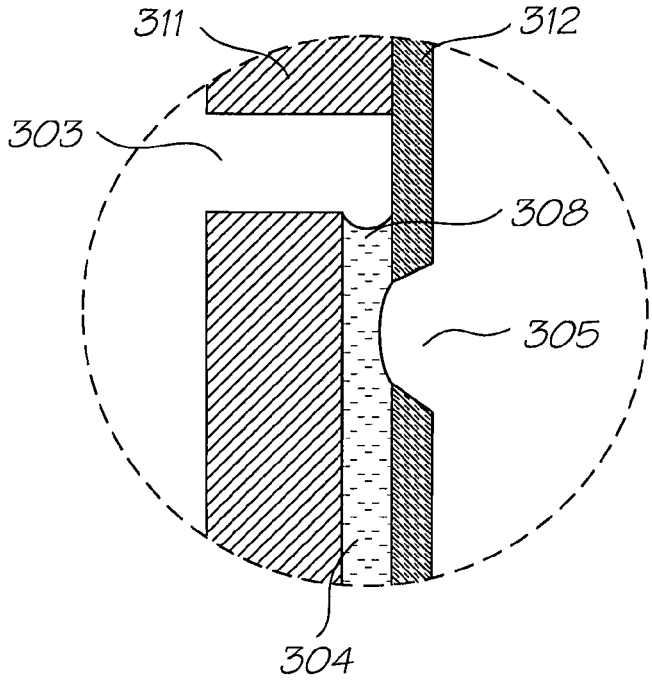
FIG. 12 is a magnified view of the bubble outlet shown in FIG. 10 during an idle period.

The bubble vent 305 is dimensioned such that the column of ink 304 has a meniscus pinned across the vent by surface tension, as shown in FIGS. 11 and 12. However, the bubble vent 305 should not be so small that it is susceptible to blockage by particulates. A bubble vent 305 having a diameter of the order of about 1 mm has been found to be suitable.

In practice, during idle periods when there is no significant pressure in the headspace 340 of the ink chamber 301, the column of ink 304 rises above the bubble outlet 307 and typically pins across the entrance to the air channel 308, as shown in FIG. 12.

Figure 13:
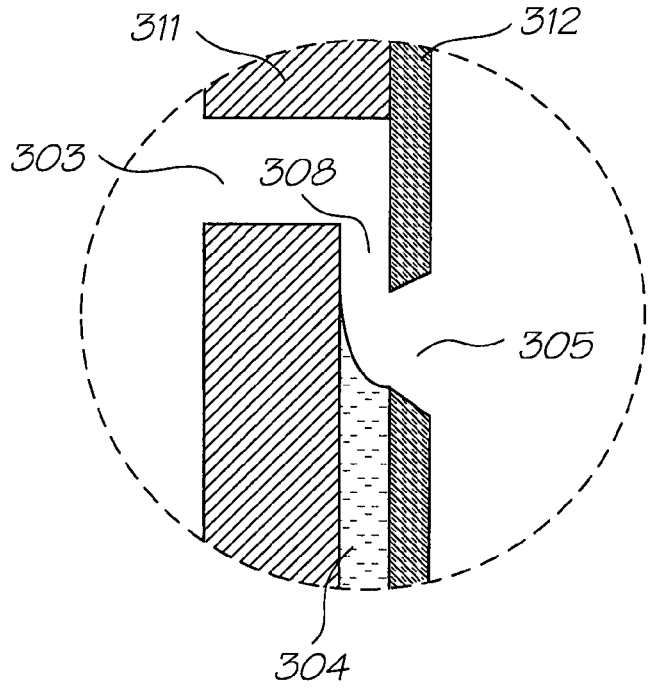
FIG. 13 is a magnified view of the bubble outlet shown in FIG. 10 during an instant when the headspace is venting after having been positively pressurized.
Figure 14:
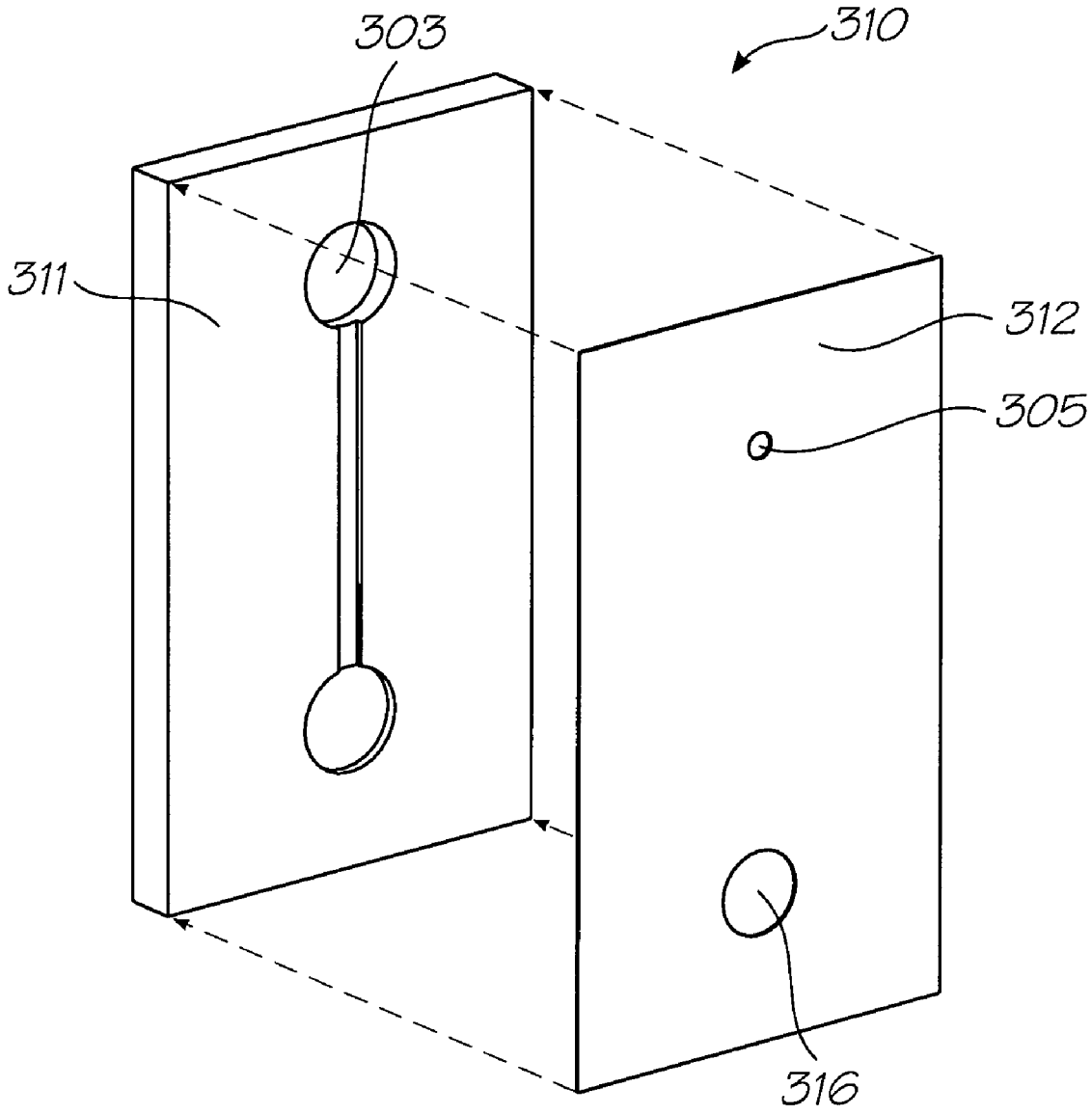
FIG. 14 is an exploded perspective view of the air intake plate shown in FIG. 10.

A significant advantage of the present embodiment is demonstrated in FIG. 13. FIG. 13 shows the situation where a positive pressure is built up in the headspace 340 during an idle period. The pressurized air forces any ink from the air channel 308 and the air escapes from the chamber 301 via the air inlet 303. Accordingly, only minute quantities of ink escape from the chamber 301 when the headspace 340 becomes pressurized due to temperature rises.

A further advantage of the present embodiment is that the air channel 308 is relatively short, thereby minimizing any flow resistance in the air channel and allowing high flow rates of ink from the chamber 301 with optimal pressure control. Any flow resistance problems (such as those described above in connection with the embodiment shown in FIG. 4) are therefore avoided.

Ink Supply System

It will be readily appreciated that the pressure regulators described herein may be incorporated into an ink supply system for an inkjet printer. The Applicant has developed previously a circulatory ink supply system comprising a pair of peristaltic pumps. The pumps are configurable for priming, depriming and printhead purging operations. This ink supply system is described in U.S. application Ser. No. 11/415,819, the contents of which is herein incorporated by reference.

Figure 15:
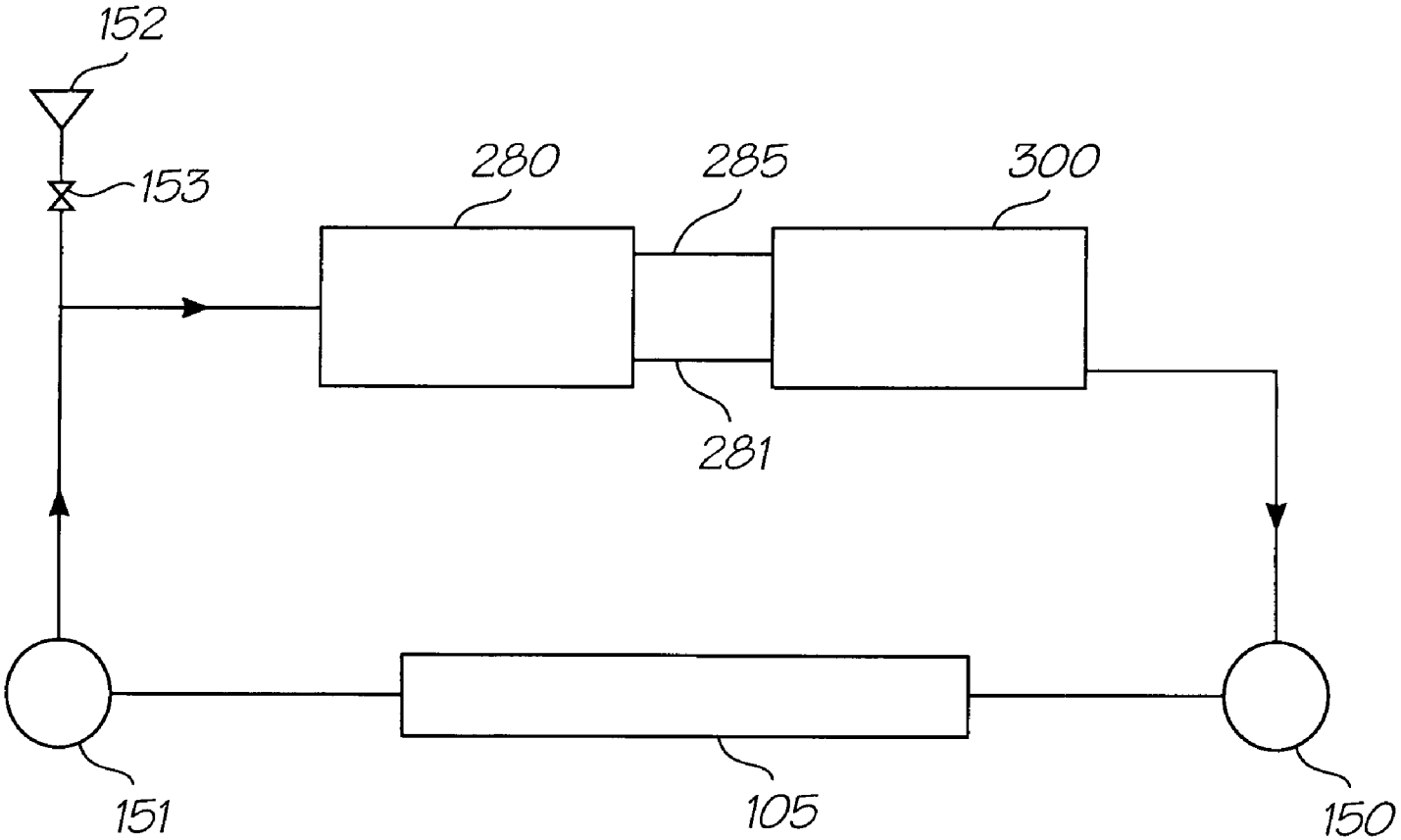
FIG. 15 shows schematically an ink supply according to the present invention.

FIG. 15 shows schematically a circulatory ink supply system incorporating an ink pressure regulator according to the present invention. As shown in FIG. 15, the ink pressure regulator 300 is connected to a replaceable ink cartridge 280 via an ink connector 281 and a pressure-equalizing connector 285. However, it will of course be appreciated that the ink pressure regulator 300 may be incorporated into a replaceable ink cartridge, as already described above.

The ink supply system comprises a printhead 105 connected to an upstream pump 150 and a downstream pump 151. The ink cartridge 280 and ink pressure regulator 300 complete the circuit.

During normal printing, the upstream pump 150 is left open and the ink pressure regulator 300 controls the hydrostatic ink pressure in the system.

During storage, both pumps 150 and 151 are shut off to isolate the printhead 105. Priming of the printhead 105 can be achieved by pumping ink to the printhead using the upstream pump 150. Similarly, depriming of the printhead 105 can be achieved by pumping ink from the printhead back to the ink cartridge 280 using downstream pump 151. The ink cartridge 280 typically comprises a filter for filtering any ink returned to it by the downstream pump 151.

The printhead 105 may also be purged with air supplied from air inlet 152 by opening check valve 153 and pumping the downstream pump 151 in a reverse direction. The air purge generates a froth or foam of ink at the printhead face, which is used for maintenance operations, as described in our copending U.S. application Ser. Nos. 11/495,815, 11/495,816 and 11/495,817, the contents of which are herein incorporated by reference.

Minimizing Ink Leakages

From the foregoing, it will be appreciated that the pressure regulator and/or ink cartridge are required to have a plurality of apertures or ports (e.g. bubble outlet, pressure-release valve, ink return inlet etc.). Each of these represents a potential leakage point for ink, especially if the pressure regulator and/or ink cartridge is tipped. Any leakage of ink, other than in the supply of ink to the printhead, is clearly undesirable.

Accordingly, the pressure regulator and/or ink cartridge should be designed in such a way as to minimize undesirable leakages via, for example, the bubble outlet. Certain design criteria are immutable: if the bubble outlet bubbles air into the ink, then it must be positioned towards the base of the ink chamber; the ink outlet must also be positioned towards the base of the ink chamber; the pressure-release outlet must be positioned towards a roof of the ink chamber.

Figure 16:
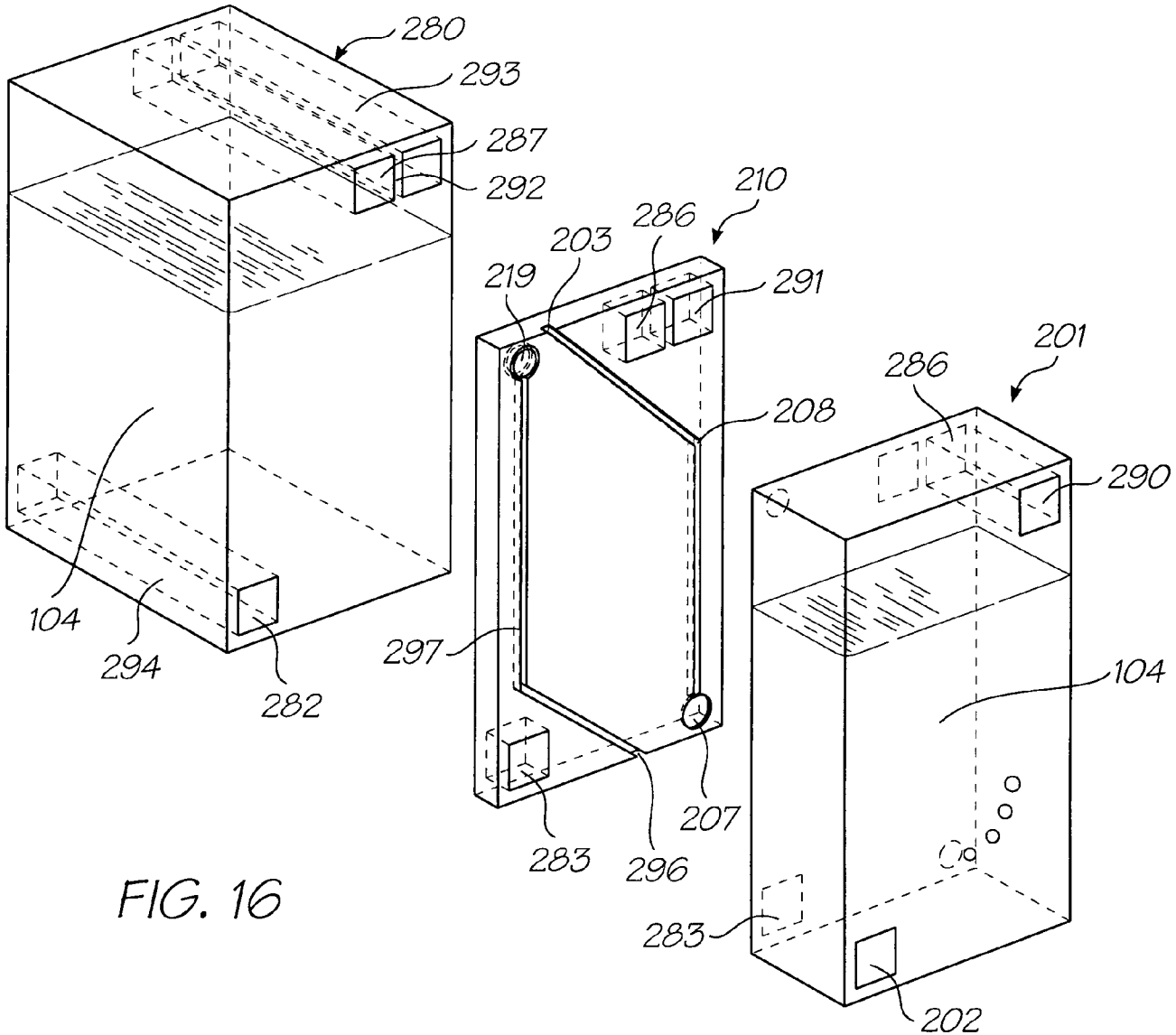
FIG. 16 is a schematic perspective view of an ink cartridge and pressure regulator configured for minimal ink leakages.
Figure 17:
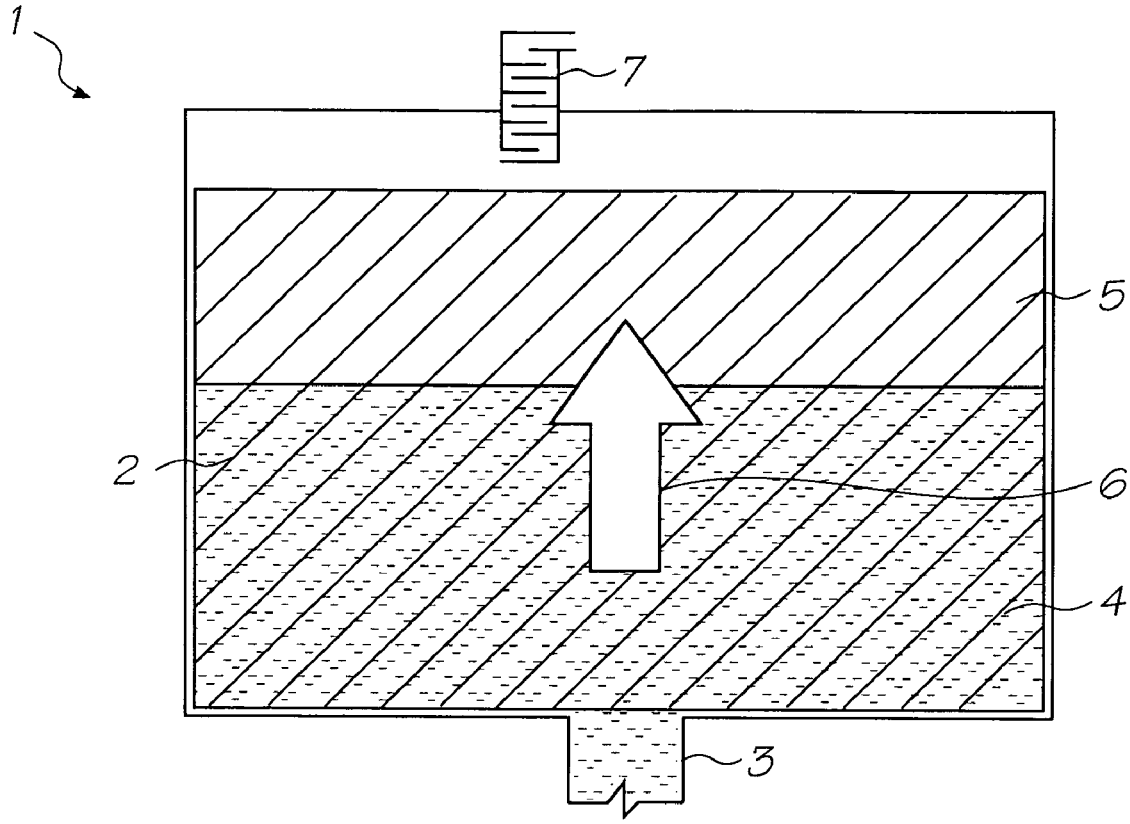
FIG. 17 (PRIOR ART)
FIG. 17 is a schematic side section of a prior art ink cartridge incorporating a foam insert.

FIG. 16 shows schematically a combined pressure regulator/ink cartridge system of the type shown in FIG. 9, which is suitable for use in the ink supply system shown in FIG. 15. The system comprises an ink chamber 201, an ink cartridge 280 and an air intake plate 210. In use, the air intake plate 210 is fixed to the ink chamber 201 and the ink cartridge 280 is removably engaged with the air intake plate.

Ink is supplied from ink chamber 201 via ink outlet 202 and ink is returned to the ink cartridge 280 via ink return inlet 290, which feeds ink to an ink return opening 291 in the air intake plate 210 and into a return conduit 292 extending longitudinally in the headspace 241 of the ink cartridge 280. A pressure-equalizing conduit 293 adjacent the ink return conduit 292 communicates with the headspace 241 in the ink chamber via pressure-equalizing ports 286 and 287. Ink is fed from the ink cartridge 280 to the ink chamber 201 via an ink outlet port 282 communicating with a corresponding ink inlet port 283 in the ink chamber. An ink supply conduit 294 extends longitudinally along the base of the ink cartridge and supplies ink to the ink outlet port 282. The use of longitudinal conduits 294, 293 and 292 in the ink cartridge minimizes ink leakages when the cartridge is tipped.

The air intake plate 210 comprises the bubble outlet 207 in a first corner and the pressure-release valve 219 in an opposite second corner. In order to minimize ink leakages via the bubble outlet 207, the air inlet 203 is positioned at the second corner and the air channel 208 is bent towards the second corner. Likewise, a pressure-release outlet 296 is positioned at the first corner and a pressure-release channel 297 communicating with the pressure-release valve 219 is bent towards the first corner.

It will, of course, be appreciated that the present invention has been described purely by way of example and that modifications of detail may be made within the scope of the invention, which is defined by the accompanying claims.

The invention claimed is:

1. An ink pressure regulator for regulating a hydrostatic pressure of ink supplied to an inkjet printhead, said regulator comprising:

an ink chamber having an ink outlet for fluid communication with the printhead via an ink line;

an air inlet open to atmosphere;

an air channel connected to the air inlet, said air channel having a constriction defining a bubble outlet, said bubble outlet being configured as a slot having a length dimension which is longer than a width dimension, said bubble outlet being positioned for bubbling air into ink contained in the chamber, wherein said width dimension of said slot is dimensioned to control a Laplace pressure of air bubbles drawn into said ink as result of supplying ink to the printhead, thereby regulating a hydrostatic pressure of the ink.

2. The pressure regulator of claim 1, wherein said ink chamber is an ink reservoir for a printer.

3. The pressure regulator of claim 1, wherein said ink chamber has an ink inlet port for fluid communication with an ink reservoir.

4. The pressure regulator of claim 1, wherein said width dimension of said slot is less than 200 microns.

5. The pressure regulator of claim 1, wherein each cross-sectional dimension of said air channel is greater than the width of the slot, thereby minimizing flow resistance in the air channel.

6. The pressure regulator of claim 1, wherein said air channel is bent or tortuous for minimizing ink losses through the air inlet.

7. The pressure regulator of claim 1, wherein said air channel is dimensioned such that a maximum capillary volume of ink in said channel is less than about 0.1 mL.

8. The pressure regulator of claim 1, further comprising a pressure release valve for releasing excess pressure in a headspace above ink in said chamber.

9. The pressure regulator of claim 1, wherein one wall of said chamber comprises an air intake plate, said plate comprising the air inlet, the air channel and the bubble outlet.

10. The pressure regulator of claim 9, wherein said plate comprises a plurality of laminated layers, said layers cooperating to define the air inlet, the air channel and the bubble outlet.

11. The pressure regulator of claim 10, wherein said plate comprises:

a first layer having an air inlet opening defined therethrough and an elongate recess defined in a first face thereof, said recess extending longitudinally from said air inlet aperture to a terminus; and a second layer laminated to said first face, said second layer having a bubble vent opening defined therethrough, wherein said bubble vent opening is positioned for fluid communication with said terminus.

12. The pressure regulator of claim 11, wherein said first face has a moat defined therein, said moat protecting said recess from adhesive during lamination of the first and second layers.

13. The pressure of regulator of claim 11, wherein a depth of said recess towards said terminus defines a critical dimension of said bubble outlet, said critical dimension controlling a Laplace pressure of air bubbles exiting said bubble outlet.

14. The pressure regulator of claim 13, wherein said recess has a shallower portion at said terminus, said shallower portion providing said constriction in said air channel.

15. The pressure regulator of claim 14, wherein said terminus is defined by a circular recess having a diameter greater than said bubble vent opening, thereby providing a bubble outlet defined by an annular slot.

* * * * *